US008657040B2

(12) United States Patent
Marshall et al.

(10) Patent No.: US 8,657,040 B2
(45) Date of Patent: Feb. 25, 2014

(54) PERCUSSION DRILLING ASSEMBLY AND LOCKING SYSTEM THEREFOR

(75) Inventors: Alan Jackson Marshall, Lost Creek, WV (US); Shantanu Swadi, Cypress, TX (US); James A. Simson, Meadows Place, TX (US)

(73) Assignee: Smith International, Inc., Houston, TX (US)

( * ) Notice: Subject to any disclaimer, the term of this patent is extended or adjusted under 35 U.S.C. 154(b) by 434 days.

(21) Appl. No.: 12/407,338

(22) Filed: Mar. 19, 2009

(65) Prior Publication Data

US 2010/0236835 A1 Sep. 23, 2010

(51) Int. Cl.
*E21B 10/36* (2006.01)

(52) U.S. Cl.
USPC ..... 175/306; 175/296; 175/293; 175/415

(58) Field of Classification Search
USPC ..... 175/293, 296, 306, 415
See application file for complete search history.

(56) References Cited

U.S. PATENT DOCUMENTS 3,405,771 A * 10/1968 Carr et al. ..... 175/73
4,705,118 A * 11/1987 Ennis ..... 175/65
RE36,848 E * 9/2000 Bui et al. ..... 175/65
6,609,577 B2 * 8/2003 Beccu ..... 173/93.6
2010/0139979 A1 6/2010 Marshall

FOREIGN PATENT DOCUMENTS

EP 0127560 A2 12/1984
WO 8503757 A1 8/1985
WO 2005113190 A1 12/2005

OTHER PUBLICATIONS

International Search Report and Written Opinion issued Dec. 21, 2012 in corresponding PCT application No. PCT/US2012/040416 (9 pages).

* cited by examiner

*Primary Examiner* — Shane Bomar
*Assistant Examiner* — Elizabeth Gitlin
(74) *Attorney, Agent, or Firm* — Osha • Liang LLP

(57) ABSTRACT

A percussion drilling assembly includes an outer tubular, an inner tubular coupled within the outer tubular at a threaded region, a drill bit slideably disposed within the inner tubular, and a locking system located proximate the threaded region. The locking system is actuatable by translation of the drill bit relative to the locking system, whereby the locking system is configured to prevent rotation of the inner tubular relative to the outer tubular in at least a first direction.

24 Claims, 25 Drawing Sheets

A - A

Section C-C

Section D-D

PERCUSSION DRILLING ASSEMBLY AND LOCKING SYSTEM THEREFOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The disclosure relates generally to earth boring bits used to drill a borehole for applications including the recovery of oil, gas or minerals, mining, blast holes, water wells and construction projects. More particularly, the disclosure relates to percussion drilling assemblies. Still more particularly, the disclosure relates to percussion drilling assemblies with a locking mechanism to prevent disengagement of a driver sub from a case.

In percussion or hammer drilling operations, a drill bit mounted to the lower end of a drill string simultaneously rotates and impacts the earth in a cyclic fashion to crush, break, and loosen formation material. In such operations, the mechanism for penetrating the earthen formation is of an impacting nature, rather than shearing. The impacting and rotating hammer bit engages the earthen formation and proceeds to form a borehole along a predetermined path toward a target zone.

A percussion drilling assembly typically includes a piston-cylinder assembly coupled to the hammer bit. Impact force is generated by the piston-cylinder assembly and transferred to the hammer bit. During drilling operations, a pressurized or compressed fluid, e.g., compressed air, flows down the drill string to the percussion drilling assembly. A choke is provided to regulate the flow of the compressed fluid to the piston-cylinder assembly and the hammer bit. A portion of the compressed fluid flows through a series of ports and passages to the piston-cylinder assembly, thereby actuating the reciprocal motion of the piston, and then is exhausted through a series of passages in the hammer bit body to the bit face. The remaining fraction of the compressed fluid flows through the choke and into the series of passages in the hammer bit body to the bit face. The compressed fluid exiting the bit face serves to flush cuttings away from the bit face to the surface through the annulus between the drill string and the borehole sidewall.

A typical percussion drilling assembly 10 is illustrated in FIG. 1. Percussion drilling assembly 10 is connected to the lower end of a drill string 15 and includes a top sub 20, a driver sub 40, a tubular case 30 axially disposed between top sub 20 and driver sub 40, and a hammer bit 60 slidingly received by driver sub 40. Top sub 20 is threadingly coupled between drill string 15 and case 30. A piston 35 is slidably disposed in case 30 above hammer bit 60. A fluid conduit 50 extends between top sub 20 and the upper end of piston 35, while a guide sleeve 25, positioned in case 30 axially above driver sub 40, slidingly receives the lower end of piston 35.

Compressed fluid is delivered from drill string 15 through top sub 20 and fluid conduit 50 to upper and lower piston-cylinder chambers to actuate piston 35. As is known in the art, percussion drilling assemblies may alternatively utilize an air distributor assembly, from which air is directed into the upper and lower piston-cylinder chambers 39, 38, respectively. As compressed fluid is alternatingly delivered to upper and lower piston-cylinder chambers 39, 38, piston 35 is actuated to cyclically impact hammer bit 60. Guide sleeve 25 maintains fluid communication between piston 35 and bit 60 as piston 35 moves relative to hammer bit 60.

The lower end of case 30 is threadingly coupled to the upper end of driver sub 40. Hammer bit 60 slideably engages driver sub 40. A series of generally axial mating splines on bit 60 and driver sub 40 allow bit 60 to move axially relative to driver sub 40 while simultaneously allowing driver sub 40 to rotate bit 60 with drill string 15 and case 30. A bit retaining ring 45 is disposed about the upper end of hammer bit 60 above driver sub 40, and a retainer sleeve 55 is coupled to driver sub 40 and extends along the outer periphery of hammer bit 60. Bit retaining ring 45 prevents hammer bit 60 from completely disengaging assembly 10. The retainer sleeve 55 generally provides a secondary catch mechanism that allows the lower enlarged head of hammer bit 60 to be extracted from the wellbore in the event of a breakage of the enlarged bit head.

During drilling operations, percussion drilling assembly 10 may be in one of three positions: on-bottom, fully closed; off-bottom, fully open; and on-bottom, partially closed (or off-bottom, partially open). In the on-bottom, fully closed position, bit 60 engages the formation and is installed in driver sub 40 with a shoulder 65 of bit 60 abutting the lower end of driver sub 40. This is the optimal position for drilling when sufficient weight is applied to bit 60. In the off-bottom, fully open position, bit 60 does not engage the formation and is fully extended relative to driver sub 40, but prevented from disengaging assembly 10 by bit retaining rings 45. In this position, percussion drilling assembly 10 ceases to impact the formation. In the on-bottom, partially closed (or off-bottom, partially open) position, drill bit 60 is partially, but not fully, extended such that shoulder 65 of bit 60 does not engage the lower end of driver sub 40. This is the non-optimal drilling position that occurs when insufficient weight is applied to bit 60 and may result in loosening of threaded connections within percussion drilling assembly 10.

Motions of the percussion drilling assembly during operation and vibrations resulting from repeated impact of piston 35 with bit 60 and of bit 60 with the formation can cause threaded connections, such as the threaded connection between case 30 and driver sub 40, to become loose and unthread. Other situations that promote unthreading may be improper connection make-up at the surface, inconsistent or inadequate weight-on-bit during drilling operations, and improper operation of the hammer due to downhole conditions. In the event that driver sub 40 disengages case 30, drilling operations cannot continue. Instead, case 30 must be pulled from the borehole, and a costly fishing operation ensues to retrieve driver sub 40 and any other component which has also disengaged from assembly 10, such as drill bit 60 and bit retaining ring 45. If the disengaged components cannot be retrieved, it may be necessary to redirect or sidetrack the borehole before drilling may continue.

Accordingly, there is a need for locking mechanisms to prevent unthreading and disengagement of a driver sub from a case within a percussion drilling assembly.

SUMMARY OF SOME OF THE PREFERRED EMBODIMENTS

These and other needs in the art are addressed in an embodiment of a percussion drilling assembly for drilling through earthen formations and forming a borehole. The percussion drilling assembly includes an outer tubular, an inner tubular that is coupled within the outer tubular, a drill bit slideably disposed within the inner tubular, and a locking system. The locking system is actuatable by translation of the drill bit relative to the locking system, whereby the locking system is configured to prevent rotation of the inner tubular relative to the outer tubular in at least a first direction.

In some embodiments, the locking system includes a plurality of locking members disposed between the inner and outer tubulars. Each locking member rotatable between an engaged position, wherein the inner tubular is prevented from rotating relative to the outer tubular in the first direction, and a disengaged position, wherein the inner tubular is rotatable relative to the outer tubular in a second direction opposite the first direction.

In other embodiments, the locking system includes a locking member that is extendable to a locked position, wherein a portion of the locking member is received within a recess formed along an inner surface of the outer tubular, whereby rotation of the inner tubular relative to the outer tubular in at least the first direction is prevented. The locking system is also retractable to an unlocked position, wherein the locking member is retracted from the recess, whereby rotation of the inner tubular relative to the outer tubular is enabled.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
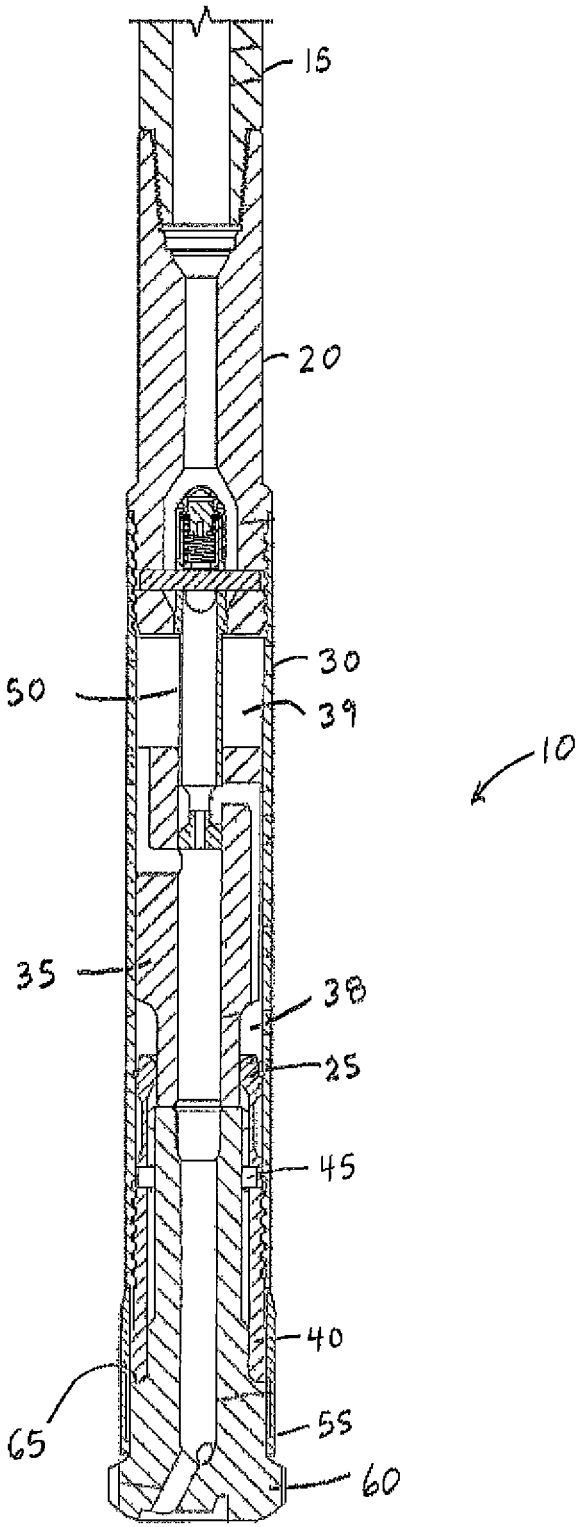
FIG. 1 (PRIOR ART)
FIG. 1 is a cross-sectional view of a conventional percussion drilling assembly coupled to a drill string.

The following discussion is directed to various exemplary embodiments of the invention. The embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis. The terms "radial" and "radially" generally mean perpendicular to the central or longitudinal axis, while the terms "azimuth" and "azimuthally" generally mean perpendicular to both the central or longitudinal axis and a radial axis normal to the central longitudinal axis. As used herein, these terms are consistent with their commonly understood meanings with regard to a cylindrical coordinate system.

Figure 2:
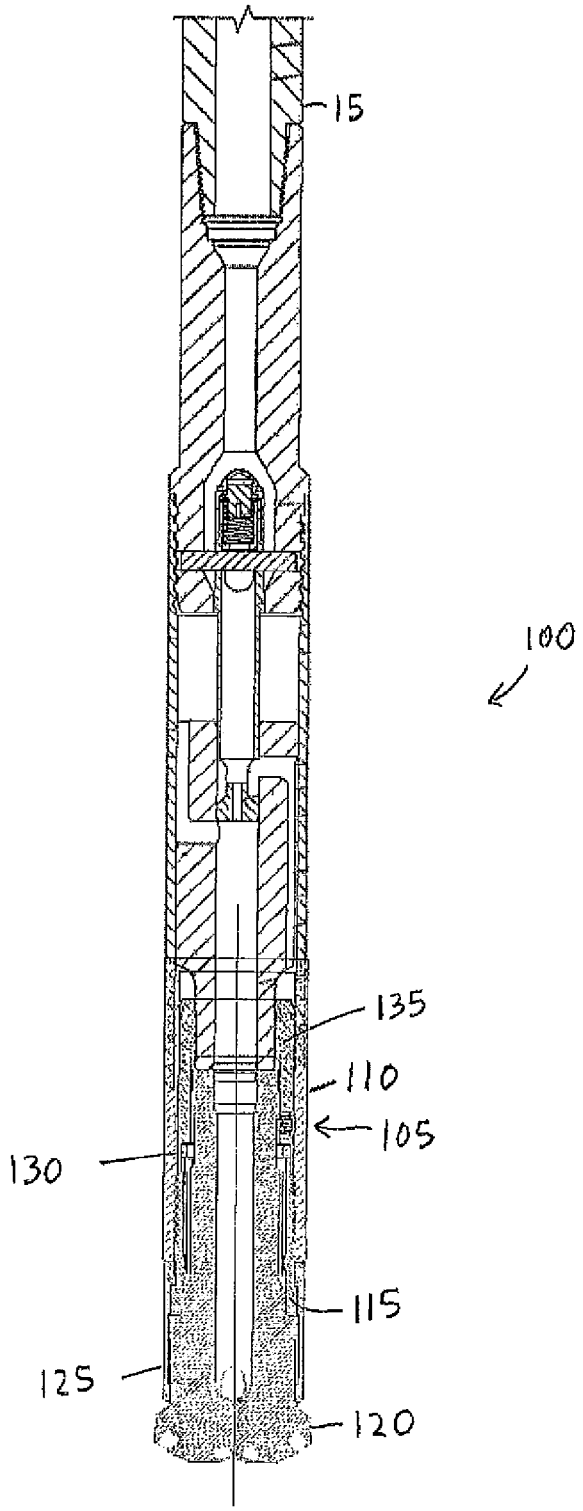
FIG. 2 is a cross-sectional view of a percussion drilling assembly including a locking system in accordance with the principles disclosed herein coupled to a drill string.

Embodiments disclosed herein are directed to locking mechanisms or systems, which, when locked, prevent disengagement of tubulars that are coupled by rotational means, such as by threaded connections, and when unlocked, permit relative rotation of the tubulars to make-up or disassemble the tubulars. In some embodiments, the disclosed locking systems are included in percussion drilling assemblies to prevent disengagement of tubulars coupled by threaded connections during drilling operations, such as but not limited to, the threaded coupling of a guide sleeve or driver sub with a tubular case. Referring to FIG. 2, there is shown a percussion drilling assembly 100 coupled to a drill string 15 and including a locking system 105 in accordance with the principles disclosed herein. Percussion drilling assembly 100, as best viewed in FIG. 3, includes a tubular case 110 threadably coupled to a driver sub 115, a drill bit 120 slideably received by driver sub 115, a retainer sleeve 125 coupled to driver sub 115 and extending along the outer periphery of drill bit 120, and a bit retaining ring 130 and a guide sleeve 135 disposed axially upward of driver sub 115. Guide sleeve 135 includes at least one port 140 within which locking system 105 is disposed (port 140 being described and shown in more detail with respect to FIGS. 6 and 7).

Figure 4:
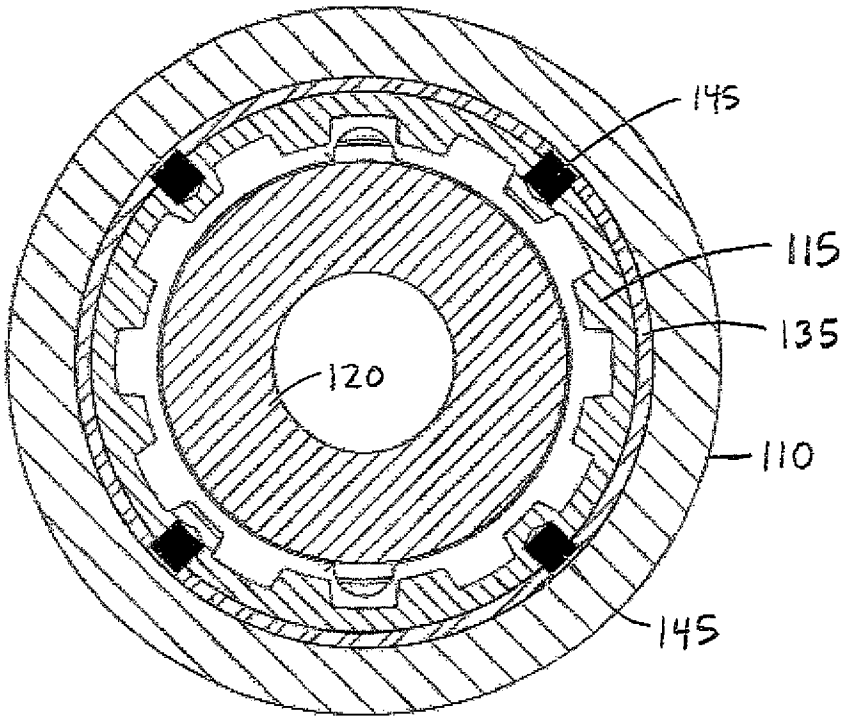
FIG. 4 is a cross-sectional view of the coupling between the guide sleeve and the driver sub taken at Section A-A of FIG. 3.

In this embodiment, guide sleeve 135 and driver sub 115 are distinct components coupled by a plurality of pins or dowels 145, as shown in FIG. 4. Each pin or dowel 145 extends radially between guide sleeve 135 and driver sub 115 to prevent rotation of guide sleeve 135 relative to driver sub 115. In other embodiments, guide sleeve 135 and driver sub 115 are integral, forming a single component threadably coupled to tubular case 110 and having at least one port 140 within which locking system 105 is disposed. Whether guide sleeve 135 and driver sub 115 are distinct components coupled by a plurality of dowels 145, as shown, or integrally formed, guide sleeve 135 does not rotate relative to driver sub 115.

Figure 3:
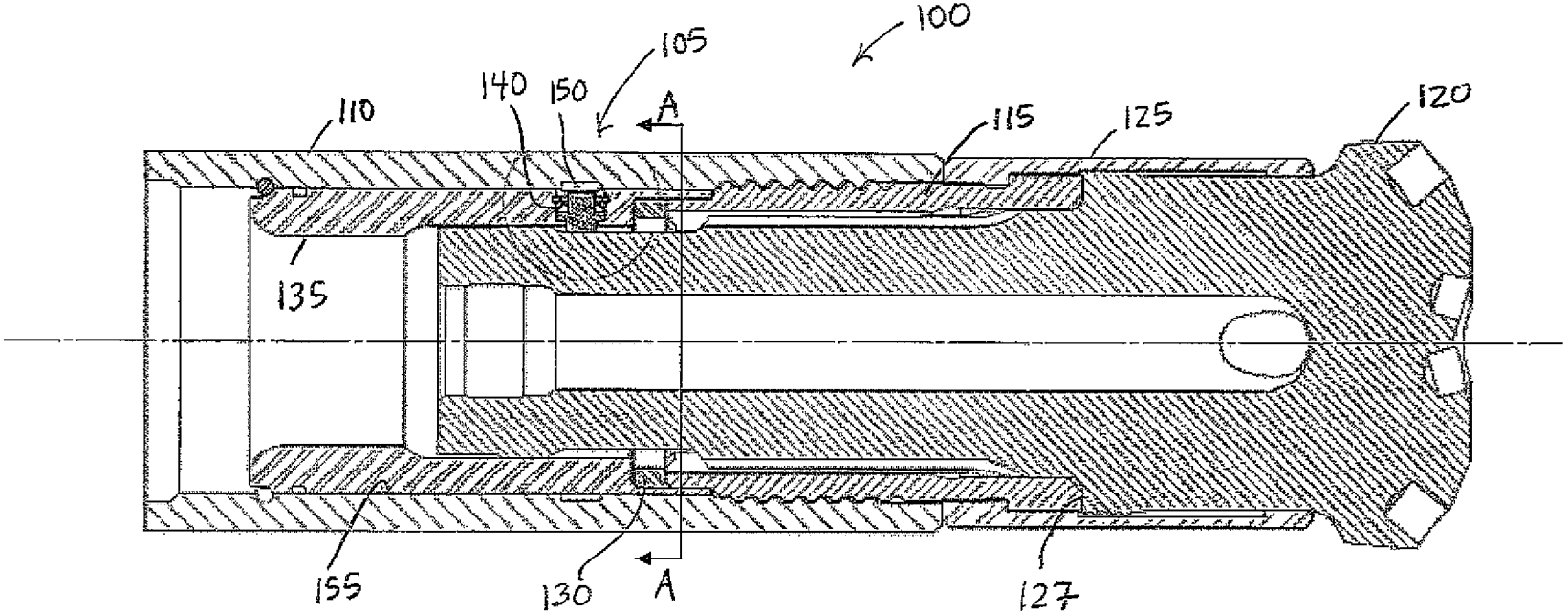
FIG. 3 is an enlarged cross-sectional view of a portion of the percussion drilling assembly of FIG. 2, wherein the locking system is unlocked.
Figure 5:
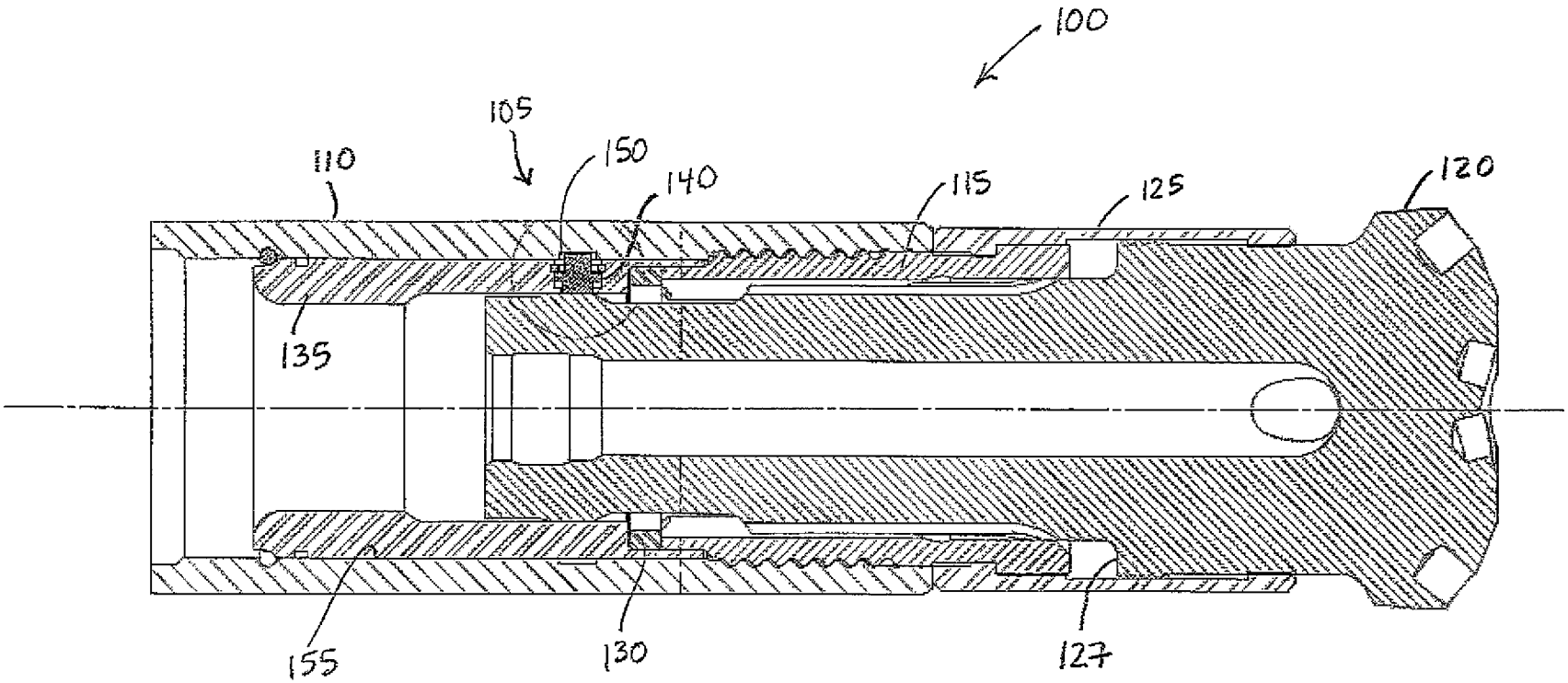
FIG. 5 is a cross-sectional view of the percussion drilling assembly of FIG. 2, wherein the locking system is locked.

Returning to FIG. 3, locking system 105 is configurable to prevent rotation of guide sleeve 135, and therefore, driver sub 115, relative to case 110, and, at other times, to permit rotation of these components 115, 135 relative to case 110. Tubular case 110 includes a pocket, groove, or recess 150 along its inner surface 155. Locking system 105 is extendable from port 140 of guide sleeve 135 into recess 150, as shown in FIG. 5, and retractable from recess 150, as shown in FIG. 3. In some embodiments, including those exemplified by FIGS. 2-7, locking system 105 is actuated by translation of drill bit 120, as will be described below. When locking system 105 extends into recess 150 of case 110 (FIG. 5), guide sleeve 135, and hence driver sub 115, is prevented by locking system 105 from rotating relative to case 110, i.e., driver sub 115 and case 110 are locked. In the locked configuration, driver sub 115 is prevented from further backing off, meaning unthreading, and completely disengaging from case 110. Thus, when driver sub 115 and case 110 are locked, loads, including vibration, to either or both components 110, 115 during operation of percussion drilling assembly 100 cannot inadvertently cause disengagement of driver sub 115 from case 110. When locking system 105 is retracted from recess 150 (FIG. 3), guide sleeve 135 is rotatable relative to case 110, i.e., driver sub 115 and case 110 are unlocked. In the unlocked configuration, driver sub 115 may be threaded into case 110, such as during make-up, or unthreaded from case 110, such as during disassembly.

Figure 6:
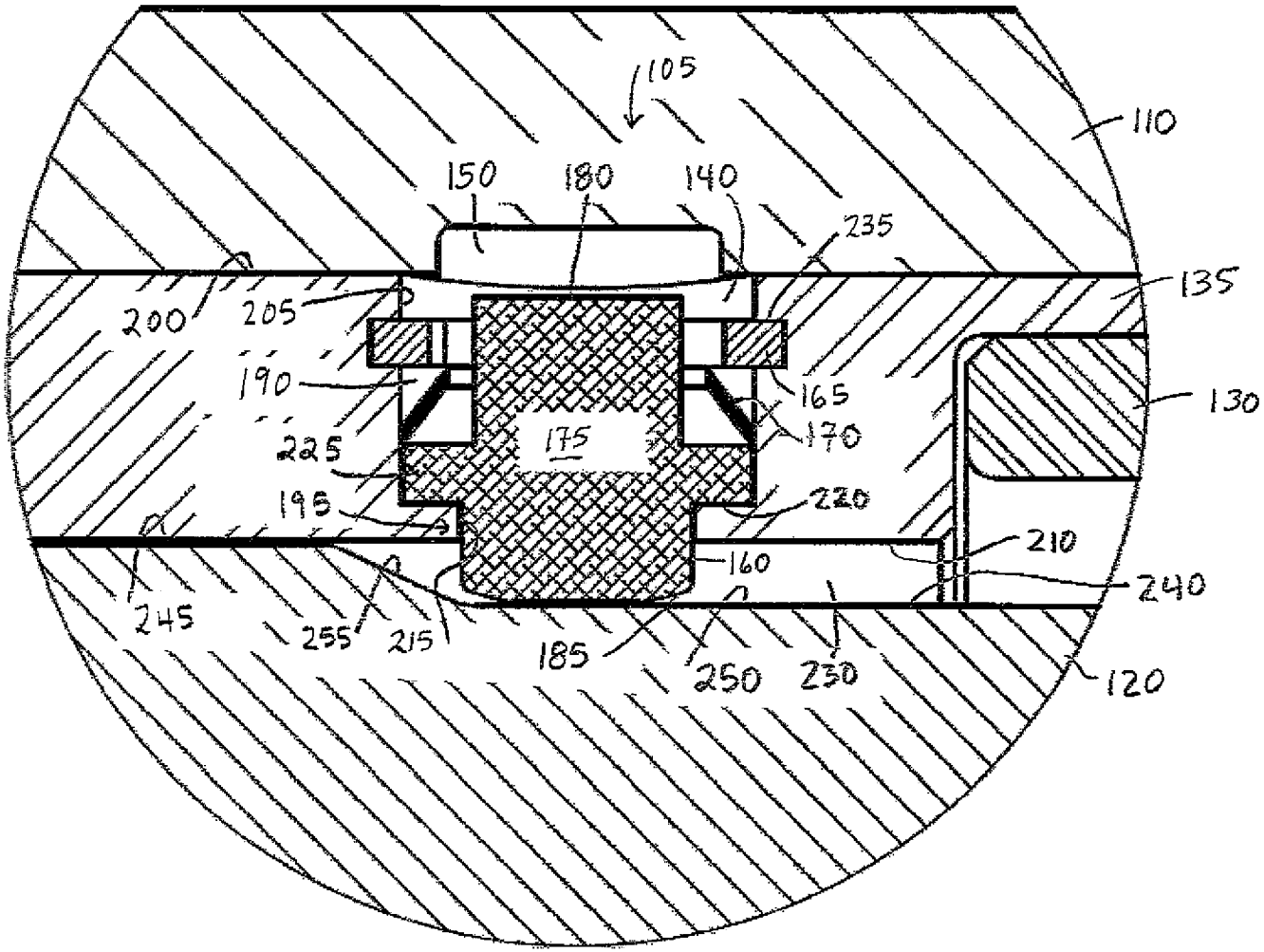
FIG. 6 is an enlarged, cross-sectional view of the locking system of FIG. 2 in its unlocked configuration.

Referring now to FIG. 6, locking system 105 is depicted within port 140 of guide sleeve 135 in its unlocked configuration, meaning retracted from recess 150 of case 110. Port 140 includes a chamber 190 connected to an opening 195. Chamber 190 extends from an outer surface 200 of guide sleeve 135 radially inward through guide sleeve 135 to opening 195, and includes inwardly-facing and radially-extending annular surfaces 205, 215. A shoulder 220 extends between surfaces 205, 215. Opening 195 extends from an inner surface 210 of guide sleeve 135 radially outward through guide sleeve 135 to chamber 190 and is bounded by substantially radially extending surface 215.

Locking system 105 includes a pin 160, a snap ring 165 disposed about pin 160, and a spring 170 positioned therebetween. Pin 160 has a body 175 extending between two ends 180, 185 and an annular flanged portion 225 extending outward from body 175. Pin 160 is radially displaceable within port 140 of guide sleeve 135 between an unlocked position and a locked position. When pin 160 is in the unlocked position, as shown in FIG. 6, end 180 of body 175 is retracted within port 140 of guide sleeve 135 and does not extend into recess 150 of case 110. Further, spring 170 is expanded against flanged portion 225 of pin 160, causing flanged portion 225 to seat against shoulder 220 of guide sleeve 135 with end 185 of body 175 extending through opening 195 of port 140 into an annular space 230 formed between guide sleeve 135 and drill bit 120. As described in greater detail below, when pin 160 is in the locked position (FIGS. 5, 7), end 185 of body 175 extends from chamber 190 of port 140 into recess 150. Further, flanged portion 225 of pin 160 is biased toward snap ring 165 with spring 170 compressed therebetween.

Referring still to FIG. 6, guide sleeve 135 further includes a recess or groove 235 in surface 205 to receive snap ring 165 of locking system 105. Snap ring 165 and shoulder 220 of guide sleeve 135 limit radial displacement of pin 160 within port 140 of guide sleeve 135 by virtue of contact with flanged portion 225 of pin 160. Hence, snap ring 165 and shoulder 220 retain pin 160 within port 140.

Spring 170 is disposed about body 175 of pin 160 between snap ring 165 and flanged portion 225 of pin 160. Spring 170 biases pin 160 to its unlocked position. To displace pin 160 from its unlocked position (FIGS. 3, 6) to its locked position (FIGS. 5, 7), a force must be applied to pin 160 wherein flanged portion 225 of pin 160 displaces radially outward to compress spring 170 against snap ring 165. When the applied force is subsequently removed, spring 170 expands, thereby returning pin 160 to its unlocked position (FIGS. 3, 6).

Figure 7:
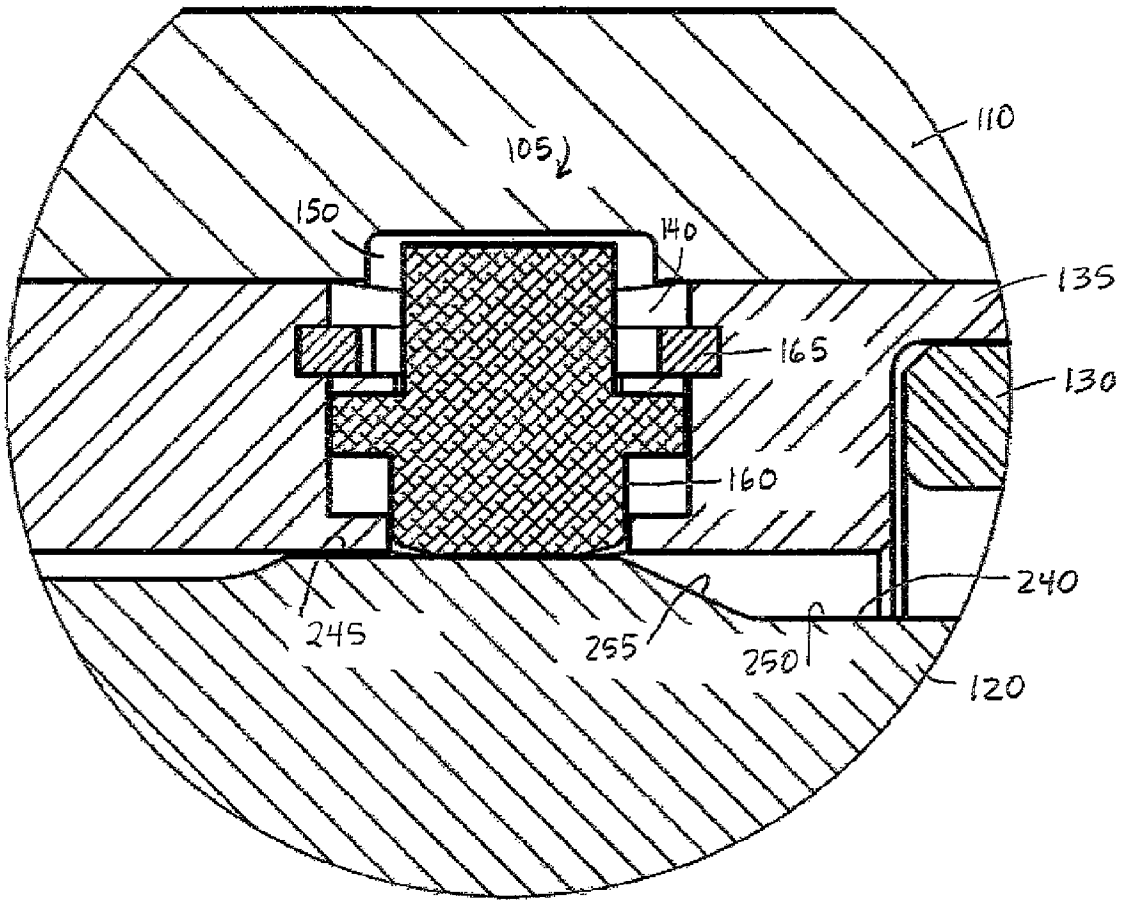
FIG. 7 is an enlarged, cross-sectional view of the locking system of FIG. 2 in its locked configuration.

In the embodiments of FIGS. 3-7, pin 160 is radially displaceable from its unlocked position (FIGS. 3, 6) to its locked position (FIGS. 5, 7) by a mechanical contact load from drill bit 120, as drill bit 120 translates axially from an on-bottom, fully closed position to an off-bottom, partially closed position. As shown in FIG. 6, drill bit 120 includes an outer surface 240 having a larger diameter portion 245, a smaller diameter portion 250, and an angled, annular shoulder 255 extending therebetween. To displace pin 160 from its unlocked position, as shown, toward its locked position (FIGS. 5, 7), drill bit 120 is translated relative to locking system 105 such that angled shoulder 255 of drill bit 120 contacts end 185 of pin 160 (meaning drill bit 120 is moving to the right in this figure). As drill bit 120 continues to translate relative to locking system 105, contact between end 185 of pin 160 and shoulder 255 of drill bit 120 causes pin 160 to displace radially outward within port 140 of guide sleeve 135, compressing spring 170 against snap ring 165. When drill bit 120 translates sufficiently to seat pin 160 against larger diameter portion 245 of drill bit 120, pin 160 reaches its locked position, as shown in FIG. 7.

To return pin 160 to its unlocked position (FIGS. 3, 6), drill bit 120 is subsequently translated in the opposite direction relative to locking system 105 to axially align end 185 of pin 160 with smaller diameter portion 250 of drill bit 120. As end 185 of pin 160 aligns with smaller diameter portion 250 of drill bit 120, the contact load of drill bit 120 is reduced, or removed entirely, from pin 160. As a result, spring 170 is allowed to expand, thereby returning pin 160 to its unlocked position (FIGS. 3, 6).

During assembly of percussion drilling assembly 100, drill bit 120 is inserted within driver sub 115 to its fully closed position with a shoulder 127 of drill bit 120 engaging the lower end of driver sub 115. In this position, locking system 105 assumes its unlocked configuration (FIGS. 3, 5) to allow driver sub 115 to be threaded into tubular case 110 without interference from or engagement of pin 160 of locking system 105 within recess 150 of tubular case 110. Next, driver sub 115 with locking system 105 disposed therein and case 110 coupled thereto. Once assembled, percussion drilling assembly 100 is inserted downhole where drilling may commence. During operation of percussion drilling assembly 100, axial translation of drill bit 120 relative to locking system 105 locks driver sub 115 to and unlocks driver sub 115 from case 110.

When drill bit 120 assumes its on-bottom position, as illustrated by FIG. 3, locking system 105 is unlocked. More specifically, smaller diameter portion 250 of drill bit 120 and locking system 105 axially align, and pin 160 is retracted from recess 150 of case 110 by expanded spring 170. Rotation of drill bit 120 during drilling acts to tighten, not disengage, the threaded coupling between case 110 and driver sub 115. Thus, it is not necessary to lock these components 110, 115 via locking system 105 when drill bit 120 is on-bottom.

When drill bit 120 is lifted off-bottom, as illustrated by FIG. 5, drill bit 120 translates axially relative to locking system 105 under its own weight, thereby causing locking system 105 to lock. More specifically, axial translation of drill bit 120 relative to guide sleeve 135 and locking system 105 causes larger diameter portion 245 of drill bit 120 to axially align with locking system 105 and engage pin 160. Engagement of pin 160 with larger diameter portion 245 of drill bit 120, in turn, causes radial displacement of pin 160 into recess 150 of case 110 and compression of spring 170 against snap ring 165. Once pin 160 extends into recess 150, rotation of drill bit 120 and vibrations resulting therefrom cannot cause driver sub 115 to inadvertently unthread or back-off from case 110.

Thus, depending upon the relative position of locking system 105 and drill bit 120, locking system 105 is locked and unlocked during operation of percussion drilling assembly 100. When drilling operations are complete and percussion drilling assembly 100 is pulled from the borehole, driver sub 115 may be disengaged from case 110 by first applying weight on drill bit 120 to return drill bit 120 in its on-bottom, fully closed position, in which shoulder 127 contacts the lower end of driver sub 115. As drill bit 120 returns to a fully closed position, locking system 105 transitions from its locked configuration to its unlocked configuration. Once locking system 105 is unlocked, driver sub 115 may be unthreaded from case 110 without interference from locking system 105.

In the above-described embodiment, driver sub 115 and case 110 are locked, such that relative rotation of these components 110, 115 is prevented, by translating drill bit 120 relative to locking system 105 to cause pin 160 to reciprocate radially in and out of engagement with case 110. In other embodiments, the driver sub and case are again locked by translating the drill bit relative to the locking system. However, in these embodiments, unlike locking system 105 described above, translation of the drill bit causes a locking member to angularly rotate into and out of engagement with the case.

Figure 8:
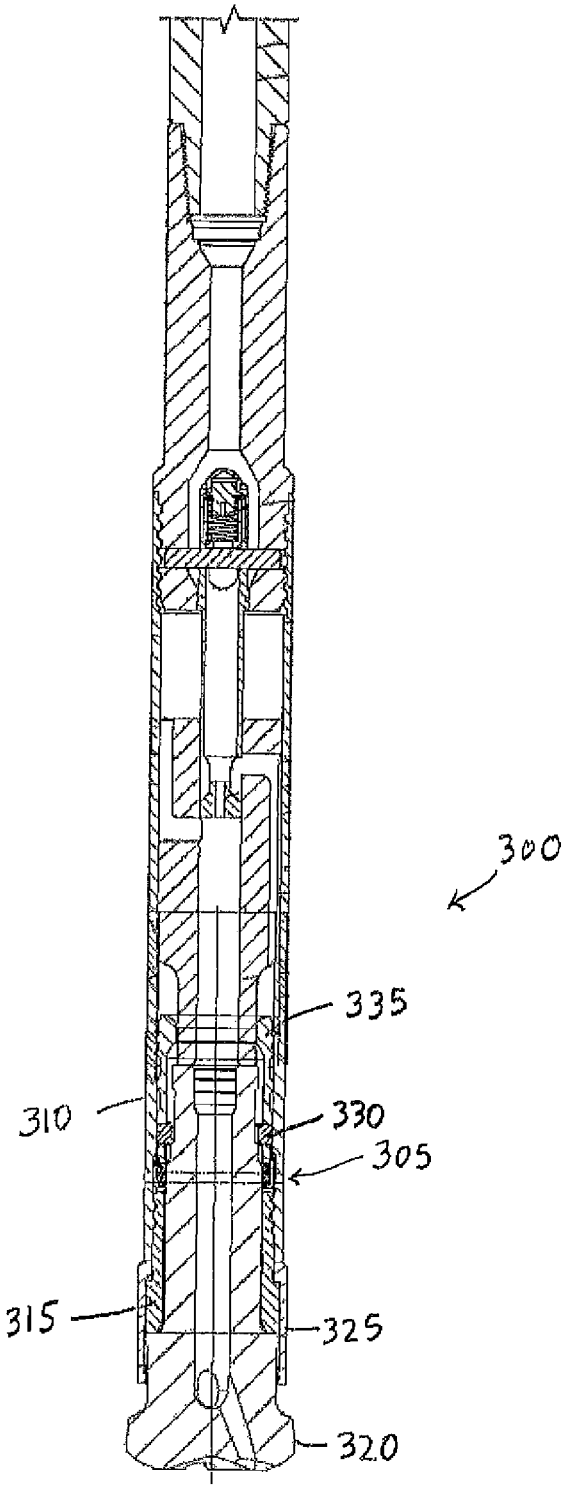
FIG. 8 is a cross-sectional view of a percussion drilling assembly including another embodiment of a locking system in accordance with the principles disclosed herein coupled to a drill string.

For example, turning to FIG. 8, there is shown a percussion drilling assembly 300 coupled to a drill string 15 and including a locking system 305 in accordance with the principles disclosed herein. Assembly 300, as best viewed in FIG. 9, includes a tubular case 310 threadably coupled to a driver sub 315, a drill bit 320 slideably received by driver sub 315, a retainer sleeve 325 coupled to driver sub 315 and extending along the outer periphery of drill bit 320, and a bit retaining ring 330 and a guide sleeve 335 disposed axially upward of driver sub 315. Driver sub 315 includes at least one port 340 within which locking system 305 is disposed. Port 340 is described and shown in more detail with respect to FIGS. 12 and 13.

Figure 9:
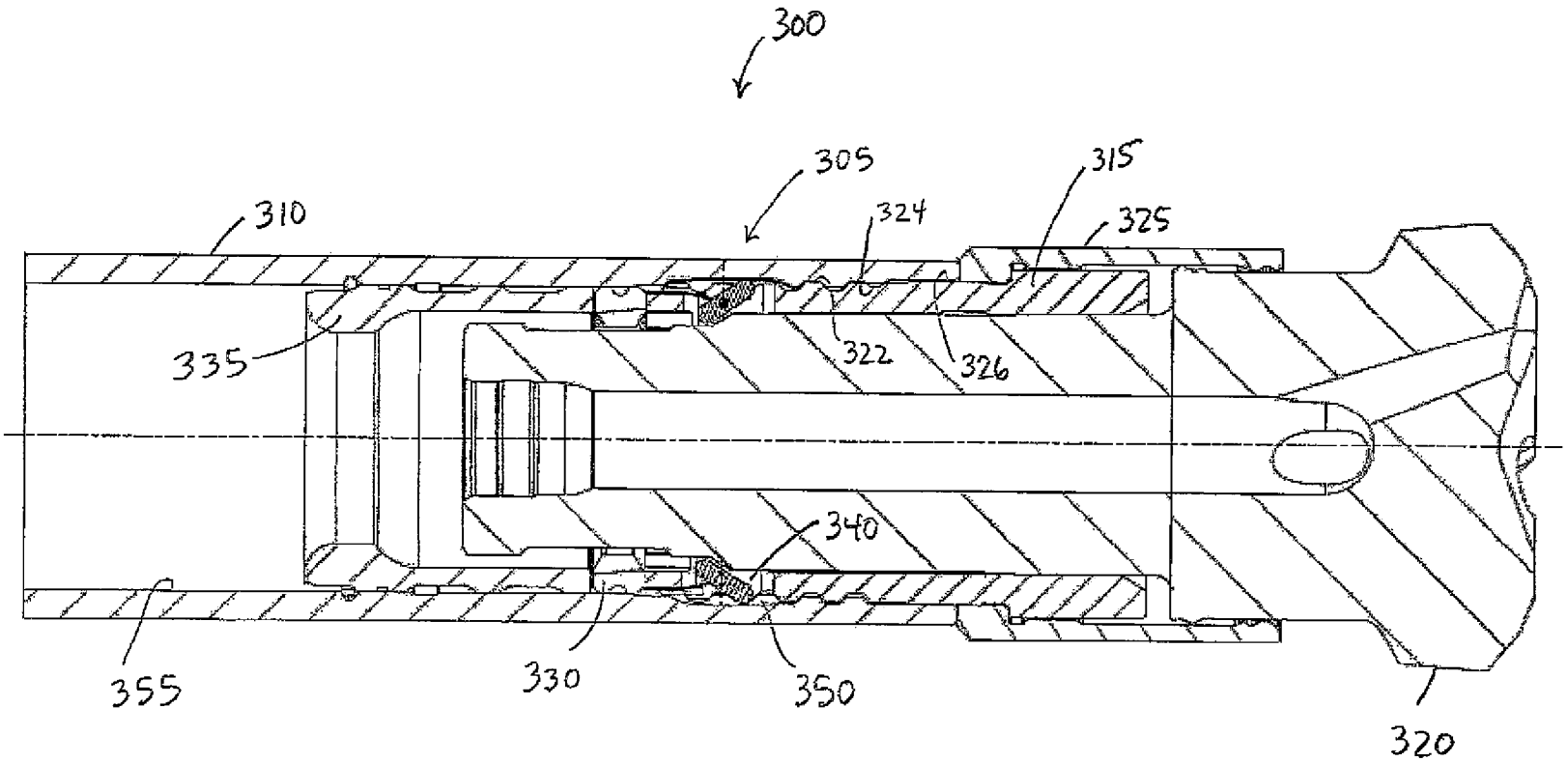
FIG. 9 is an enlarged cross-sectional view of a portion of the percussion drilling assembly of FIG. 8, wherein the locking system is locked.

Referring still to FIG. 9, port 340 extends through driver sub 315 and is axially positioned within a threaded region 322 along an outer surface 326. Case 310 includes at least one pocket or recess 350 axially positioned along its inner surface 355 within or near a threaded region 324. Driver sub 315 may be threadingly engaged to and within case 310 such that port 340 with locking system 305 disposed therein substantially aligns, axially speaking, with recess 350 of case 310, as shown. In this embodiment, driver sub 315 has four equally spaced ports 340, each receiving a locking system 305 and substantially aligned, axially speaking, with a recess 350 along inner surface 355 of case 310. The azimuthal spacing between ports 340 of driver sub 315 and between recesses 350 of case 310 are selected such that when one of ports 340 aligns azimuthally with one of recesses 350, each of the remaining ports 340 also aligns azimuthally with one of the remaining recesses 350. In other embodiments, the azimuthal spacing of ports 340 and recesses 350 may be staggered to prevent the need for excessive counterclockwise rotation to enable engagement.

Figure 10:
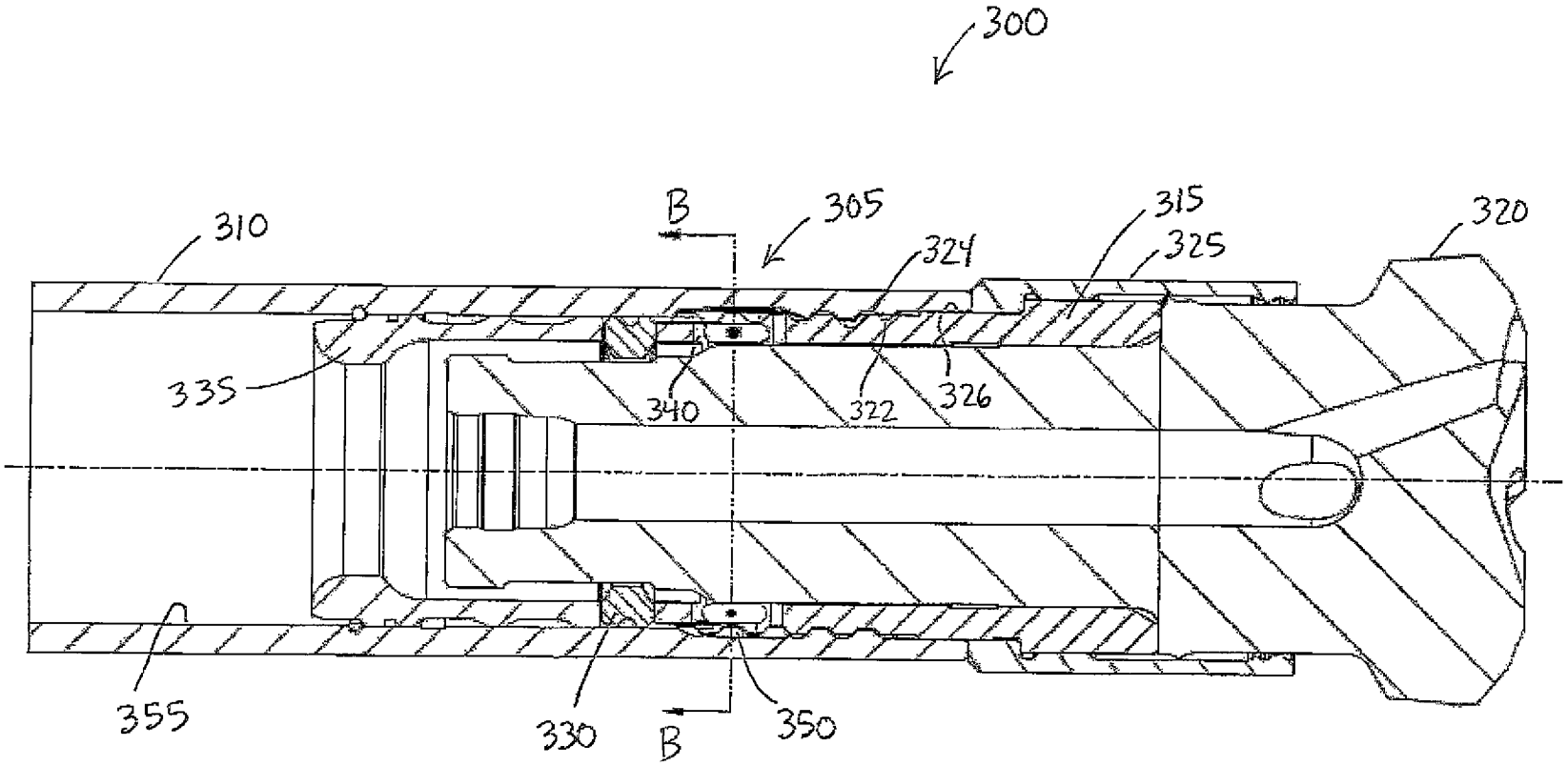
FIG. 10 is a cross-sectional view of the percussion drilling assembly of FIG. 8, wherein the locking system is unlocked.
Figure 12:
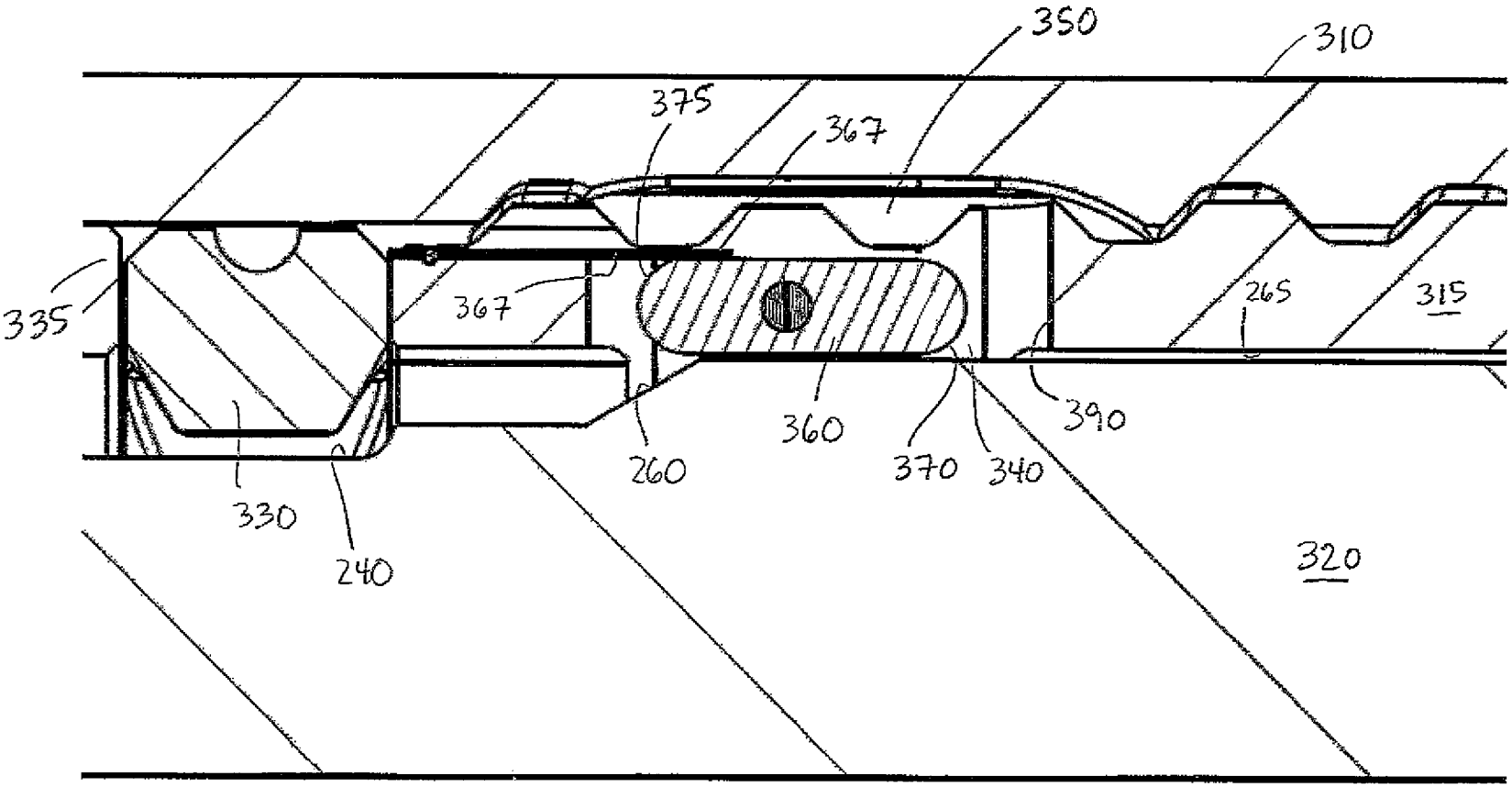
FIG. 12 is an enlarged, cross-sectional view of the locking system of FIG. 10 in its unlocked configuration.
Figure 13:
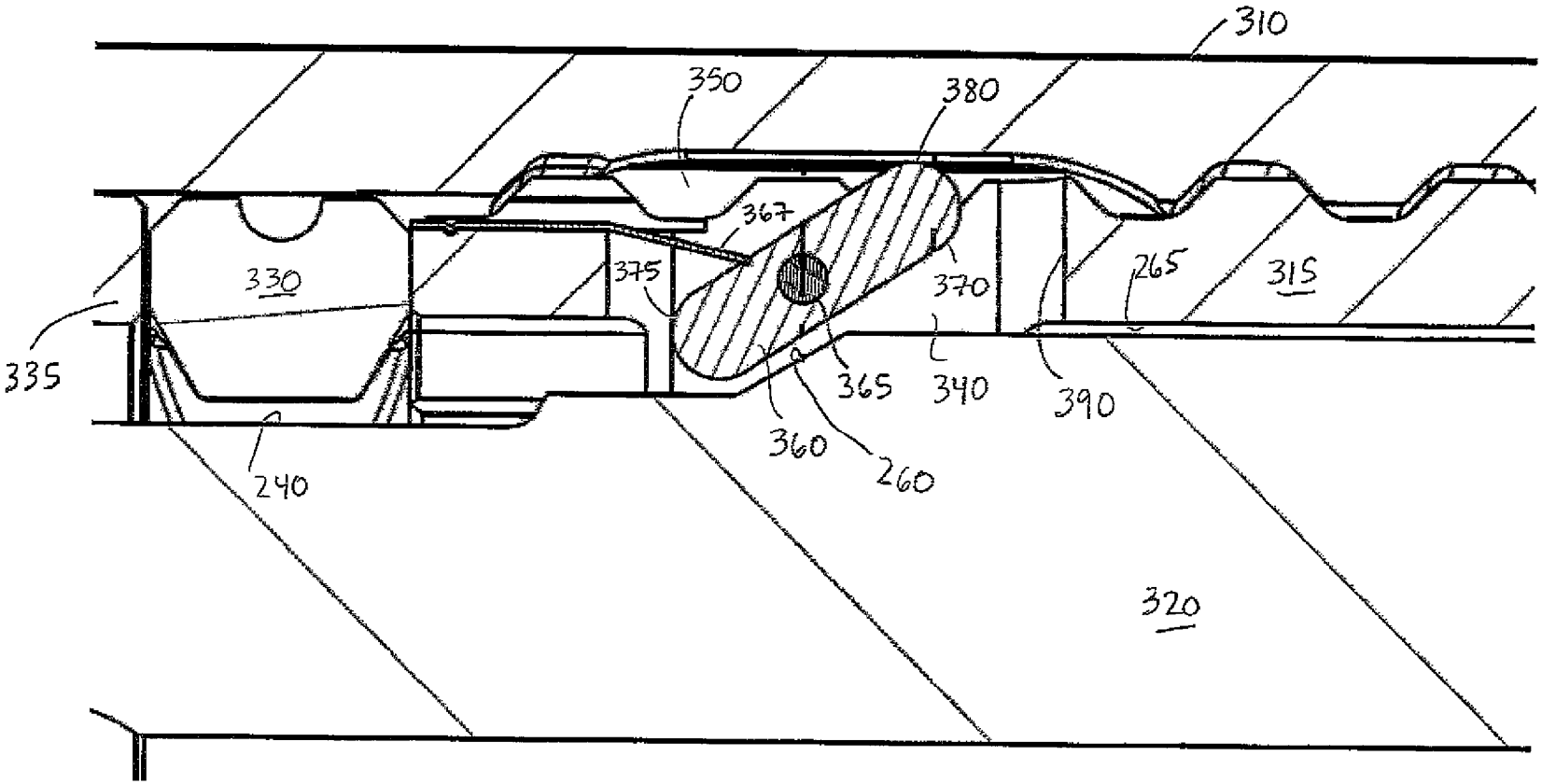
FIG. 13 is an enlarged, cross-sectional view of the locking system of FIG. 9 in its locked configuration.

Locking system 305 is configurable to prevent or permit rotation of driver sub 315 relative to tubular case 310. In particular, locking system 305 is extendable from port 340 of driver sub 315 into recess 350, as shown in FIGS. 9 and 13, and retractable from recess 350, as shown in FIGS. 10 and 12. In some embodiments, including those exemplified by FIGS. 8-13, locking system 305 is actuated by translation of drill bit 320, as will be described below. When locking system 305 extends into recess 350 of case 310 (FIGS. 9, 13), driver sub 315 is prevented by locking system 305 from rotating relative to case 310, i.e., driver sub 315 and case 310 are locked. In the locked configuration, driver sub 315 cannot unthread and disengage from case 310. Thus, when driver sub 315 and case 310 are locked, loads, including vibration, to either or both components 310, 315 during operation of percussion drilling assembly 300 cannot inadvertently cause disengagement of driver sub 315 from case 310. When the locking system 305 is retracted from recess 350 (FIGS. 10, 12), driver sub 315 is rotatable relative to case 310, i.e., driver sub 315 and case 310 are unlocked. In the unlocked configuration, driver sub 315 may be threaded into case 310, such as during make-up, or unthreaded from case 310, such as during disassembly.

Figure 11:
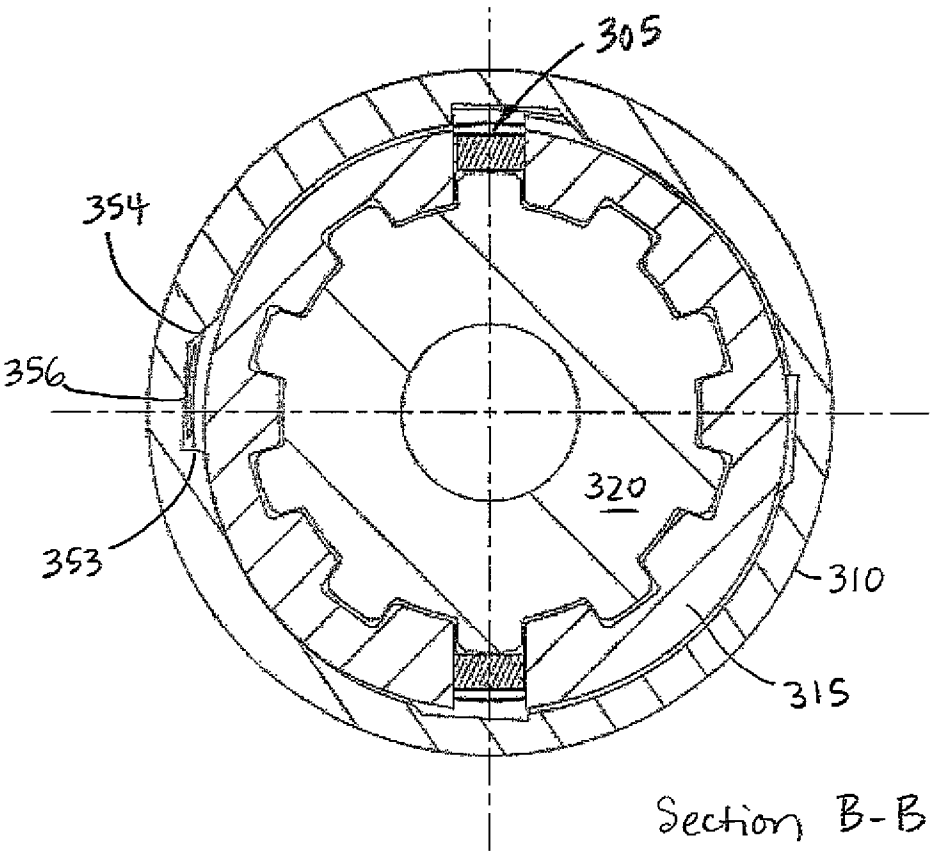
FIG. 11 is a radial cross-section through the percussion drilling assembly at Section B-B of FIG. 10.

In some embodiments, illustrated by FIG. 11, each recess 350 may be configured to facilitate threading of driver sub 315 into case 310 and to prevent unthreading of these components 310, 315. Each recess 350 is bounded along its base by a radially extending inner surface 356 of case 310 and along its sides by two axially extending surfaces 353, 354. In some embodiments, axially extending surface 353 is substantially normal to inner surface 356 to provide resistance against locking system 305 in the event driver sub 315, with locking system 305 disposed therein, rotates relative to case 310 in a direction which, in the absence of locking system 305, would enable driver sub 315 to unthread from case 310. Further, in some embodiments, the opposing axially extending surface 354 of recess 350 is not normal to inner surface 356 but is instead ramped or angled relative to inner surface 356 to permit rotation of driver sub 315 relative to case 310 in the opposite direction and to facilitate tightening of threads 322 (FIG. 9) of driver sub 315 with threads 324 (FIG. 9) of case 310.

Referring now to FIG. 12, locking system 305 is disposed within port 340 of driver sub 315 in its unlocked configuration, meaning disposed within port 340 with no portion of locking system 305 extending into recess 350 of case 310. Port 340 extends radially through driver sub 315 and includes inwardly-facing and substantially radially-extending annular surface 390. Locking system 305 includes a pin 365 extending azimuthally within port 340 and a pawl 360 that is rotatable about pin 365. Pawl 360 has at least two opposing, cropped or rounded corners 370, 375. In this embodiment, each pawl 360 is essentially rectangular in cross-section, when viewed along the azimuth direction. However, in other embodiments, pawls 360 may take other shapes.

Pawl 360 is rotatable about pin 365 between an unlocked position (FIGS. 10, 12) and a locked position (FIGS. 9, 13). When pawl 360 is in the unlocked position (FIGS. 10, 12), pawl 360 is rotated about pin 365 such that pawl 360 is contained within port 340 of driver sub 315, and no portion of pawl 360 extends into recess 350 of case 310. When pawl 360 is in the locked position (FIGS. 9, 13), pawl 360 is rotated counterclockwise relative to its unlocked position such that a portion of pawl 360 extends into recess 350 of case 310. In this embodiment, a corner 380 of pawl 360 extends into recess 350 when pawl 360 is rotated to its locked position. Each of rounded corners 370, 375 enables rotation of pawl 360 about pin 365 without limitation or interference from surface 390 of driver sub 315. Thus, when pawl 360 rotates in either direction about pin 365, corners 370, 375 do not impede this rotational movement through contact with surface 390.

Locking system 305 further includes a spring 367 coupled to pawl 360. Spring 367 exerts a force on pawl 360 to bias pawl 360 toward its locked position (FIGS. 9, 13). Hence, in the absence of other force, pawl 360 will assume its locked position (FIGS. 9, 13) with a portion of pawl 360 extending into recess 350 of case 310. To rotate pawl 360 about pin 365 from its locked position (FIGS. 9, 13) to its unlocked position (FIGS. 10, 12), a force must be applied to pawl 360 to overcome the force of spring 367 and cause pawl 360 to rotate clockwise such that pawl 360 is fully retracted from recess 350 of case 310. When the applied force is subsequently removed, spring 367 causes pawl 360 to again rotate counterclockwise, thereby returning pawl 360 to its locked position (FIGS. 9, 13).

In the embodiment of FIGS. 8-13, pawl 360 is rotatable from its locked position (FIGS. 9, 13) to its unlocked position (FIGS. 10, 12) by a contact load from drill bit 320. As shown in FIG. 12, drill bit 320 includes an outer surface 240 having a plurality of axial splines 260 configured to engage a plurality of axial splines (not shown) disposed along an inner surface of driver sub 315. Engagement of the splines on driver sub 315 with splines 260 on drill bit 320 enables case 310 to rotate drill bit 320 via driver sub 315. Further, when drill bit 320 is inserted within driver sub 315 such that at least one of splines 260 axially aligns with and engages pawl 360, pawl 360 is rotated clockwise into and held its unlocked position by the spline 260, as shown.

To rotate pawl 360 from its unlocked position (FIGS. 10, 12) toward its locked position (FIGS. 9, 13), drill bit 320 is translated relative to driver sub 315, and locking system 305 disposed therein, (meaning drill bit 120 is moving to the right in FIGS. 10 and 12) such that splines 260 of drill bit 320 disengage pawl 360. During operation of percussion drilling assembly 300, this occurs when drill bit 320 translates axially from its on-bottom to its off-bottom position. When drill bit 320 translates sufficiently to disengage pawl 360, pawl 360 rotates counterclockwise into its locked position (FIGS. 9, 13) when a counterclockwise torque is applied to cause unthreading. To return pawl 360 to its unlocked position (FIGS. 10, 12), drill bit 320 is subsequently translated in the opposite direction relative to driver sub 315. When at least one spline 260 on drill bit 320 again engages pawl 360, pawl 360 begins to rotate clockwise toward its unlocked position (FIGS. 10, 12). Continued translation of drill bit 320 causes at least one of splines 260 to axially align with and hold pawl 360 in its unlocked position (FIGS. 10, 12).

During assembly of percussion drilling assembly 300, drill bit 320 is inserted into driver sub 315 to cause locking system 305 to assume its unlocked configuration (FIGS. 10, 12). With locking system 305 in its unlocked configuration, driver sub 315 may then be threaded into tubular case 310 without interference from or engagement of pawl 360 of locking system 305 within recess 350 of tubular case 310. Once assembled, percussion drilling assembly 300 is inserted downhole where drilling may commence. During operation of percussion drilling assembly 300, axial translation and rotation of drill bit 320 relative to locking system 305 locks driver sub 315 to and unlocks driver sub 315 from case 310.

When drill bit 320 assumes its on-bottom, fully closed position, as illustrated by FIG. 10, locking system 305 is unlocked. More specifically, splines 260 on drill bit 320 axially align with locking system 305, and at least one of splines 260 engages pawl 360, thereby causing pawl 360 to rotate clockwise about pin 365 such that pawl 360 is retracted from recess 350 of case 310. Rotation of drill bit 320 during drilling acts to tighten, not disengage, the threaded coupling between case 310 and driver sub 315. Thus, it is not necessary to lock these components 310, 315 via locking system 305 when drill bit 320 is on-bottom.

When drill bit 320 is lifted off-bottom, as illustrated by FIG. 9, drill bit 320 translates axially relative to locking system 305 under its own weight, thereby causing splines 260 of drill bit 320 to disengage pawl 360. In the event that port 340 of driver sub 315 is azimuthally aligned with recess 350 of case 310, pawl 360 rotates counterclockwise about pin 365 such that a portion of pawl 360 extends into recess 350 of case 310. Once locking system 305 is locked, meaning pawl 360 extends into recess 350, rotation of drill bit 320 and vibrations resulting therefrom cannot cause driver sub 315 to inadvertently back off from case 310. If port 340 of driver sub 315 is not, however, azimuthally aligned with recess 350 of case 310, some back-off of driver sub 315 from case 310 is allowed to occur until port 340 and recess 350 align azimuthally, and pawl 360 rotates into recess 350 to lock driver sub 315 to case 310. Also, if the torque applied to the coupling of driver sub 315 and case 310 during drilling exceeds the torque required to make up this connection, pawls 360 will slide up ramped surfaces 354 of recesses 350 of case 310, thereby preventing damage to locking assembly 305 and allowing driver sub 315 to be further tightened into case 310.

Thus, depending upon the relative position of locking system 305 and drill bit 320, locking system 305 is locked and unlocked during operation of percussion drilling assembly 300. When drilling operations are complete and percussion drilling assembly 300 is pulled from the borehole, driver sub 315 may be decoupled from case 310 by first inserting drill bit 320 fully into driver sub 315 to cause locking system 305 to assume its unlocked configuration. Once locking system 305 is unlocked, driver sub 315 may be unthreaded from case 310.

Figure 14:
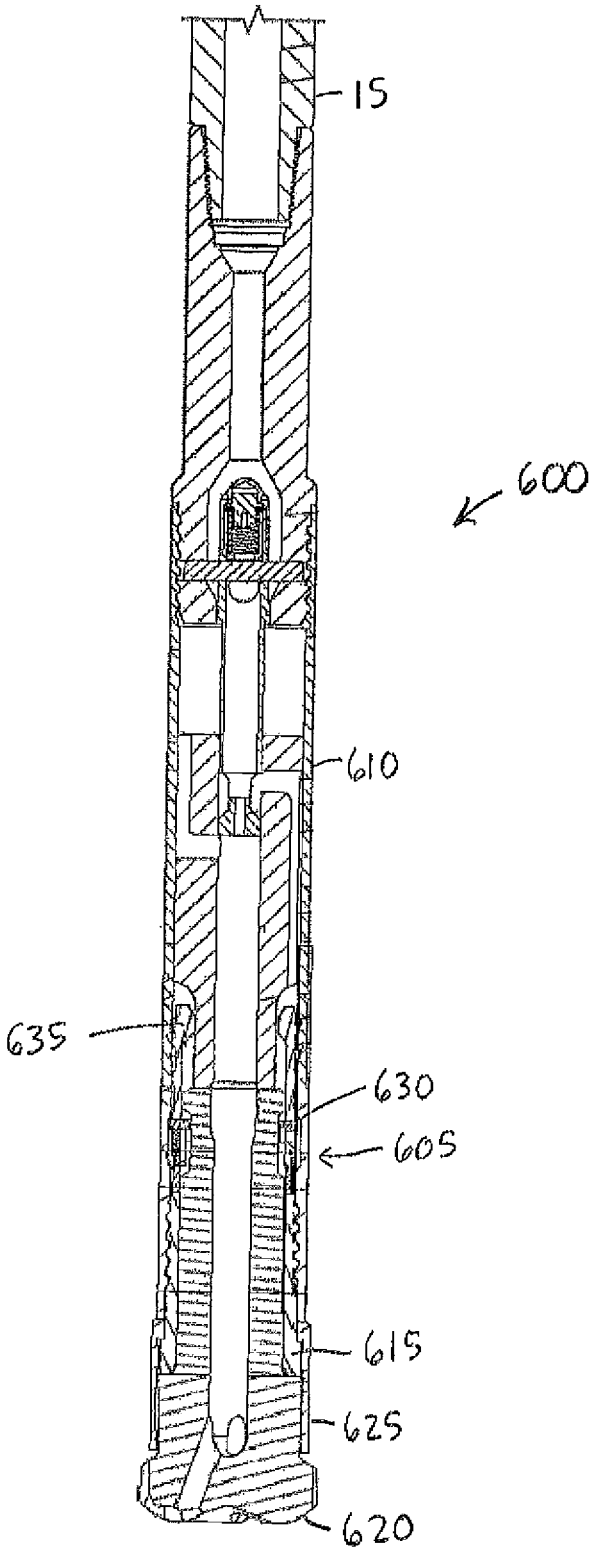
FIG. 14 is a cross-sectional view of a percussion drilling assembly including still another embodiment of a locking system in accordance with the principles disclosed herein coupled to a drill string.
Figure 15:
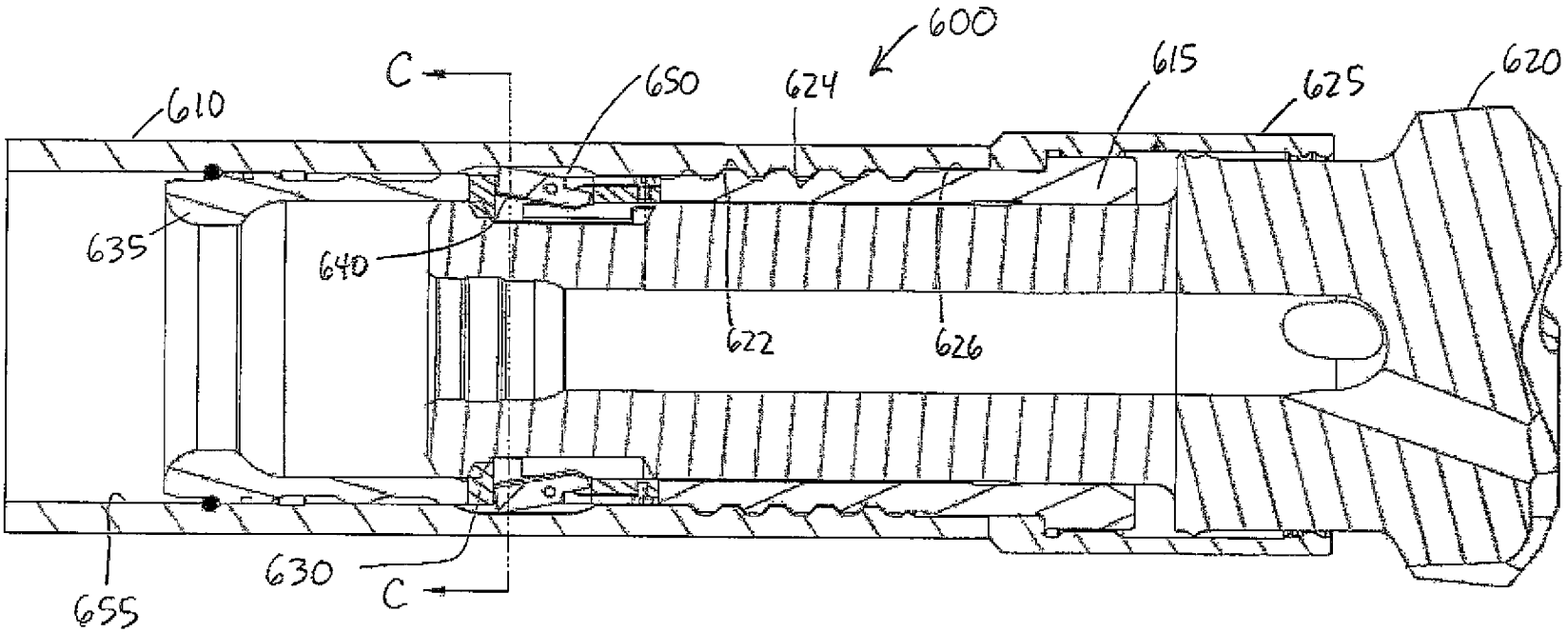
FIG. 15 is an enlarged cross-sectional view of a portion of the percussion drilling assembly of FIG. 14, wherein the locking system is locked.
Figure 16:
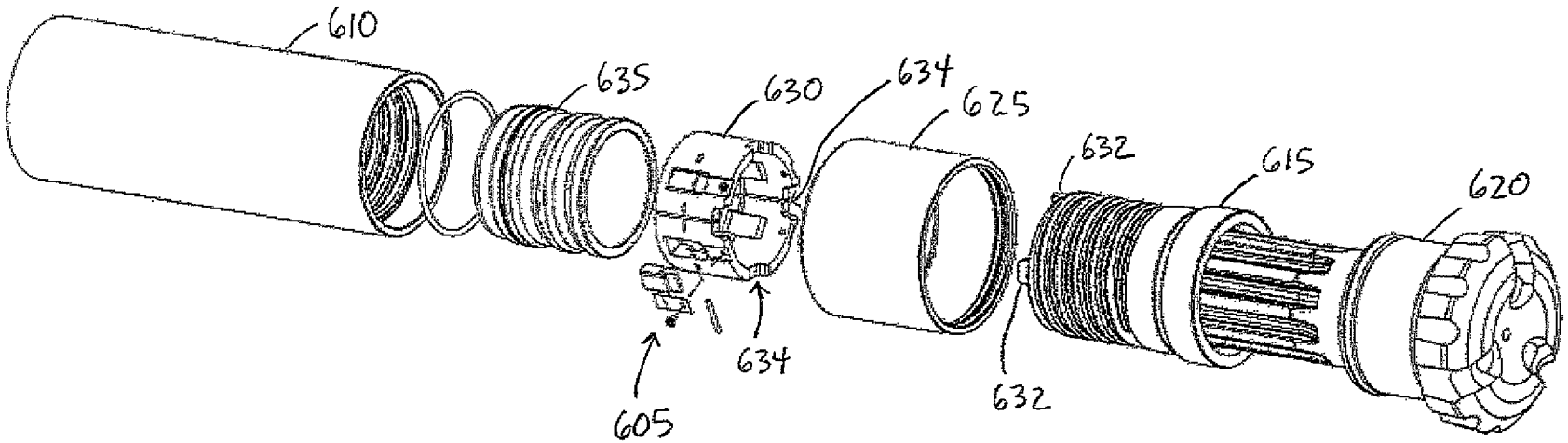
FIG. 16 is an exploded perspective view of the percussion drilling assembly of FIG. 15.

In this embodiment, port 340 with locking system 305 disposed therein and recess 350 are axially positioned within threaded regions 322, 324 of driver sub 315 and case 310, respectively. In some circumstances, it may be desirable to position port 340 with locking system 305 disposed therein and recess 350 outside of these respective threaded regions 322, 324. FIGS. 14-16 illustrate a modified embodiment of locking system 305 which functions similarly to locking system 305, but is disposed within a port in the bit retaining ring, rather than the driver sub, and is received by a recess in the tubular case that is axially disposed above the threads along the inner surface of the case.

Turning to FIG. 14, there is shown a percussion drilling assembly 600 coupled to a drill string 15 and including a locking system 605 in accordance with the principles disclosed herein. Assembly 600, as best viewed in FIG. 15, includes a tubular case 610 threadably coupled to a driver sub 615, a drill bit 620 slideably received by driver sub 615, a retainer sleeve 625 coupled to driver sub 615 and extending along the outer periphery of drill bit 620, and a bit retaining ring 630 and a guide sleeve 635 disposed axially upward of driver sub 615. Bit retaining ring 630 is coupled to driver sub 615 such that bit retaining ring 630 does not rotate relative to driver sub 615.

Referring briefly to FIG. 16, guide sleeve 635 and driver sub 615 are distinct components rotatably coupled in this embodiment by a set teeth or castellations 632 extending from driver sub 615 and an equal number of receptacles 634 on bit retaining ring 630. Driver sub 615 has four equally spaced teeth 632, each configured to be received within any one of four equally spaced receptacles 634 of bit retaining ring 630. The azimuthal spacing between teeth 632 of driver sub 315 and between receptacles 634 of bit retaining ring 630 are selected such that when one of teeth 632 aligns azimuthally with one of receptacles 634, each of the remaining teeth 632 also aligns azimuthally with one of the remaining receptacles 634. A limited amount of installation clearance exists between teeth 632 and recesses 634, but once azimuthally aligned and teeth 632 are received within receptacles 634, driver sub 615 and bit retaining ring 630 are rotationally coupled.

Referring again to FIG. 15, bit retaining ring 630 includes at least one pocket or recess 640 along its outer surface 626 within which locking system 605 is disposed. Case 610 includes a least one pocket or recess 650 along its inner surface 655 and positioned axially upward of a threaded region 624. Driver sub 615 with bit retaining ring 630 and locking system 605 coupled thereto may be threadingly coupled within case 610 such that recess 650 substantially aligns, axially speaking, with pocket 640, as shown. In this embodiment, bit retaining ring 630 has four equally spaced pockets 640, each receiving a locking system 605 and substantially aligned, axially speaking, with a recess 650 along inner surface 655 of case 610. The azimuthal spacing between pockets 640 of bit retaining ring 630 and between recesses 650 of case 610 are selected such that when one of pockets 640 aligns azimuthally with one of recesses 650, each of the remaining pockets 640 also aligns azimuthally with one of the remaining recesses 650.

Figure 17:
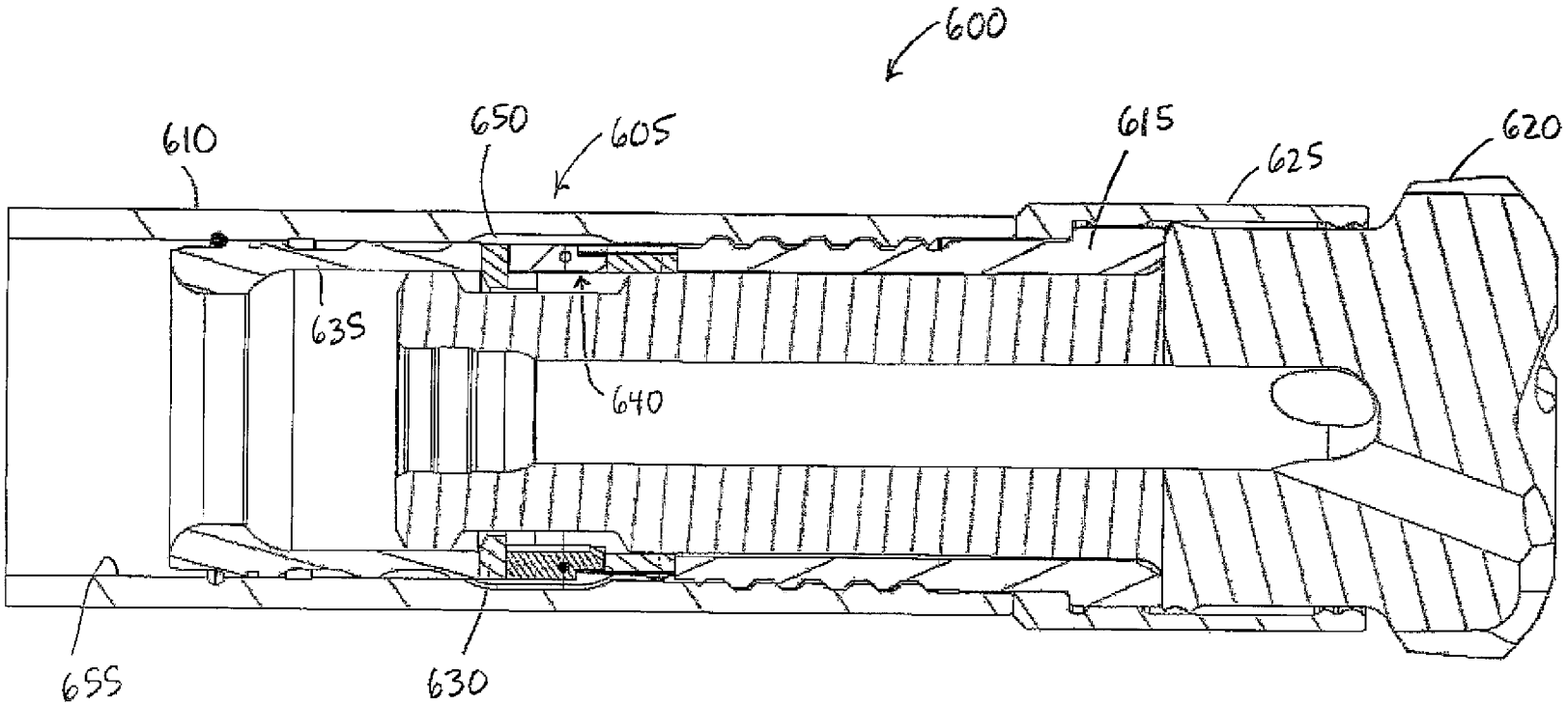
FIG. 17 is a cross-sectional view of the percussion drilling assembly of FIG. 14, wherein the locking system is unlocked.
Figure 19:
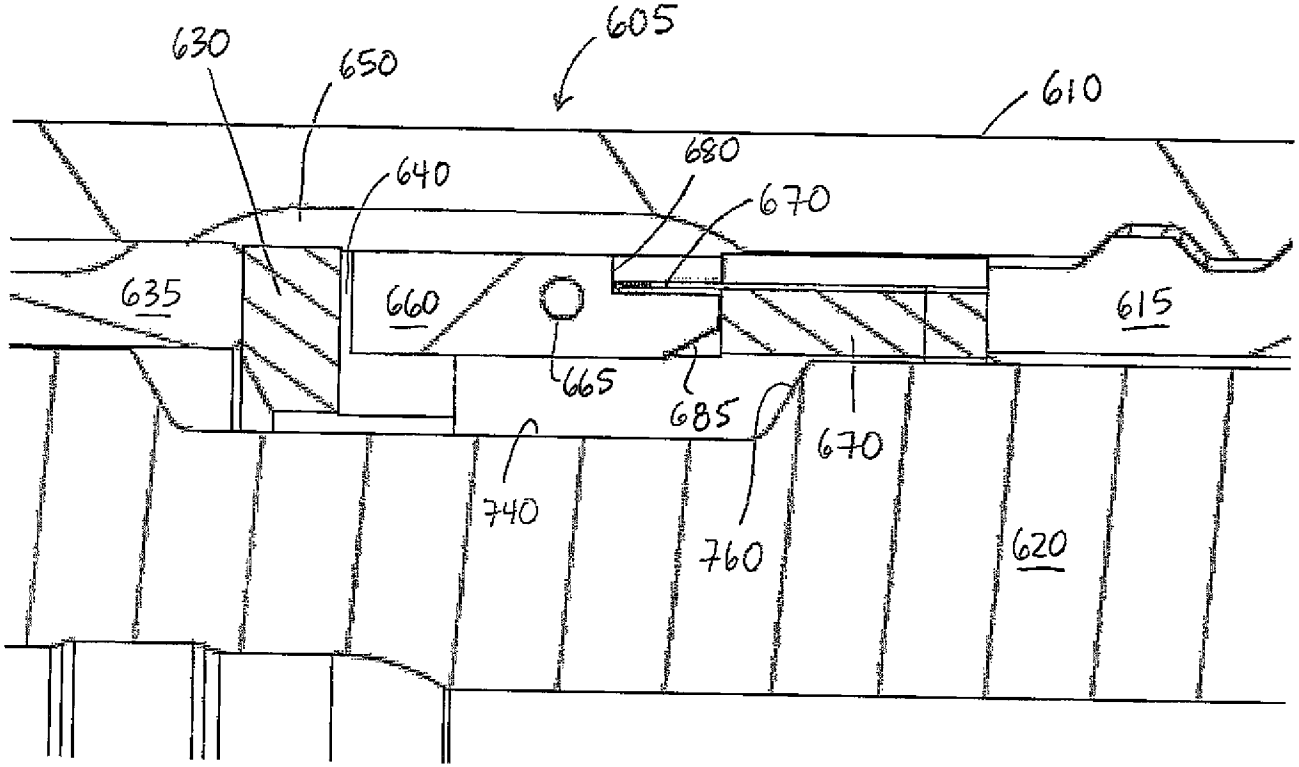
FIG. 19 is an enlarged, cross-sectional view of the locking system of FIG. 14 in its unlocked configuration.
Figure 20:
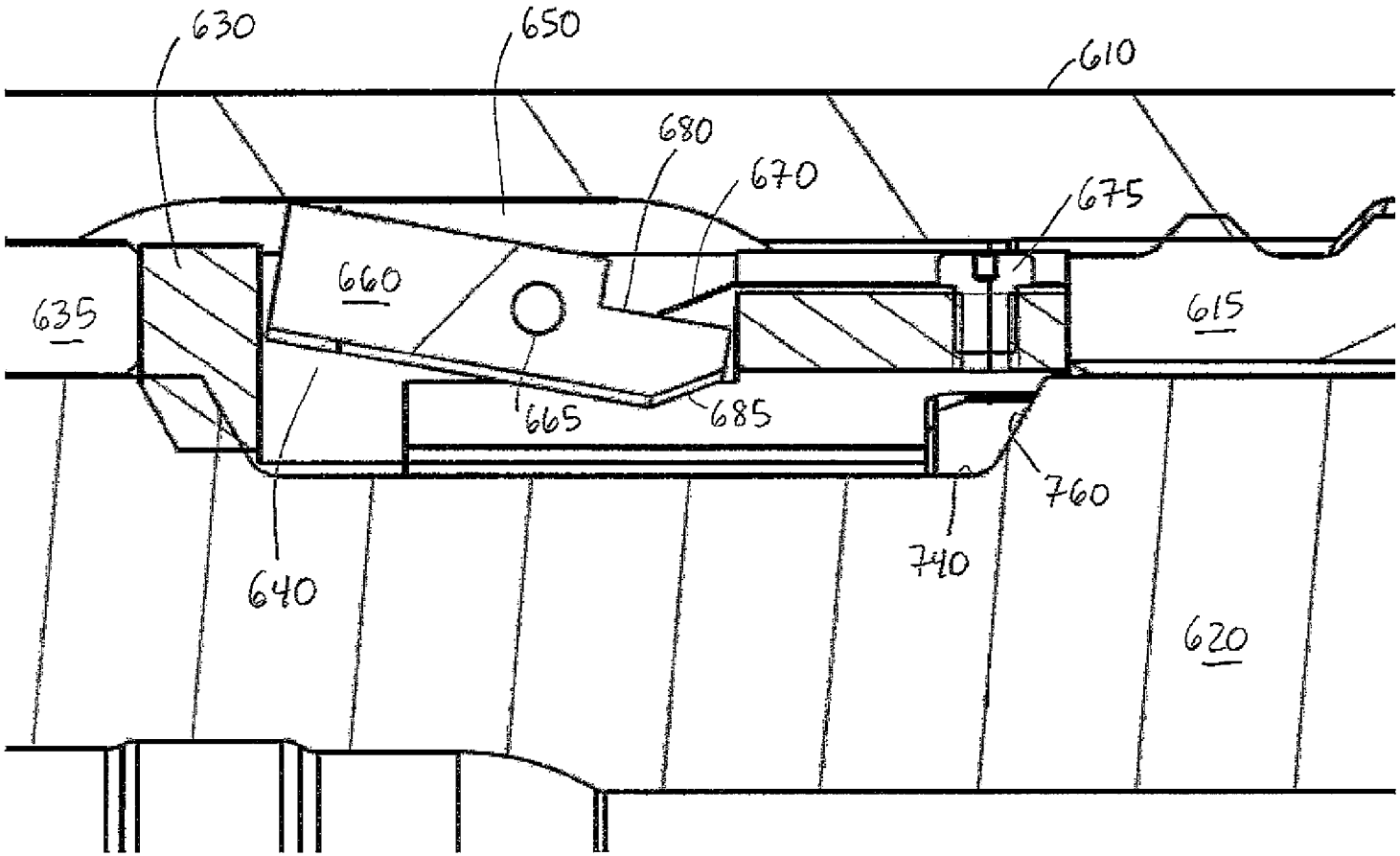
FIG. 20 is an enlarged, cross-sectional view of the locking system of FIG. 14 in its locked configuration.

Locking system 605 is configurable to prevent or permit rotation of driver sub 615 relative to tubular case 610. In particular, locking system 605 is extendable from pocket 640 of bit retaining ring 630 into recess 650, as shown in FIGS. 15 and 20, and retractable from recess 650, as shown in FIGS. 17 and 19. In some embodiments, including those exemplified by FIGS. 14-20, locking system 605 is actuated by translation of drill bit 620, as will be described below. When locking system 605 extends into recess 650 of case 610 (FIGS. 15, 20), driver sub 615 is prevented by locking system 605 from rotating relative to case 610, i.e., driver sub 615 and case 610 are locked. In the locked configuration, driver sub 615 cannot unthread and disengage from case 610. Thus, when driver sub 615 and case 610 are locked, loads, including vibration, to either or both components 610, 615 during operation of percussion drilling assembly 600 cannot inadvertently cause disengagement of driver sub 615 from case 610. When locking system 605 is retracted from recess 650 (FIGS. 17, 19), driver sub 615 is rotatable relative to case 610, i.e., driver sub 615 and case 610 are unlocked. In the unlocked configuration, driver sub 615 may be threaded into case 610, such as during make-up, or unthreaded from case 610, such as during disassembly.

Figure 18:
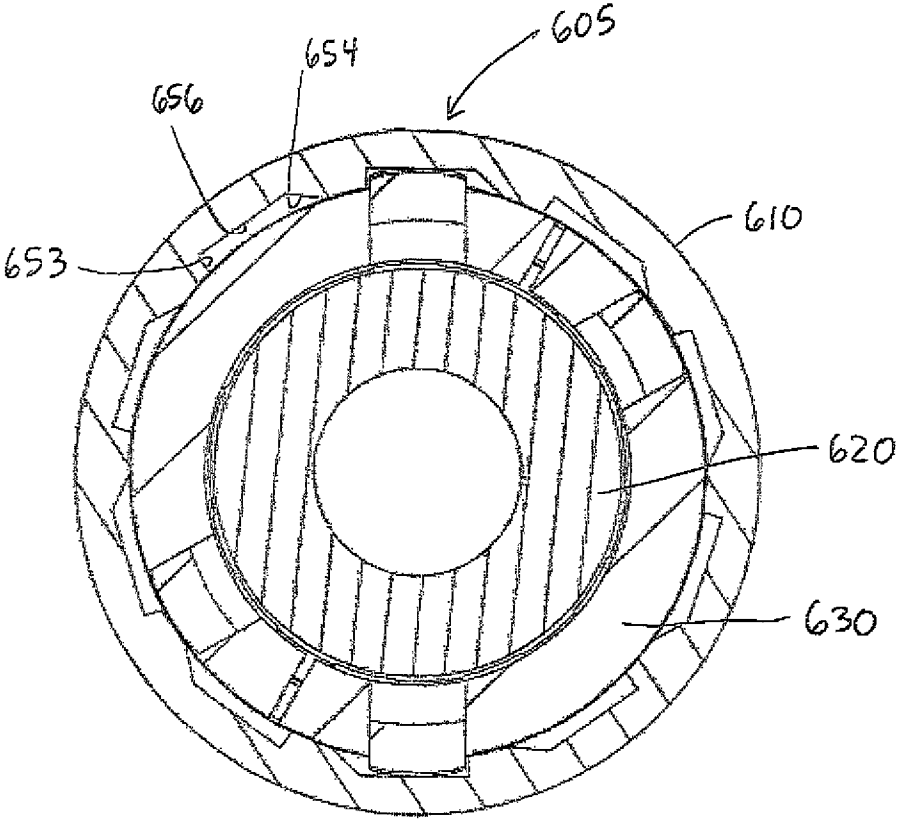
FIG. 18 is a radial cross-section through the percussion drilling assembly at Section C-C of FIG. 15.

In some embodiments, illustrated by FIG. 18, each recess 650 may be configured to facilitate threading of driver sub 615 into case 610 and to prevent unthreading of these components 610, 615. Each recess 650 is bounded along its base by a radially extending inner surface 656 of case 610 and along its sides by two axially extending surfaces 653, 654. In some embodiments, axially extending surface 653 is substantially normal to inner surface 656 to provide resistance against locking system 605 in the event driver sub 615, with bit retaining ring 630 and locking system 605 coupled thereto, rotates relative to case 610 in a direction which, in the absence of locking system 605, would enable driver sub 615 to unthread from case 610. Further, in some embodiments, the opposing axially extending surface 654 of recess 650 is not normal to inner surface 656 but is instead ramped or angled relative to inner surface 656 to permit rotation of driver sub 615 relative to case 610 in the opposite direction and to facilitate tightening of threads 622 (FIG. 15) of driver sub 615 with threads 624 (FIG. 15) of case 610.

Referring now to FIG. 19, locking system 605 is disposed within pocket 640 of bit retaining ring 630 in its unlocked configuration, meaning disposed within pocket 640 with no portion of locking system 605 extending into recess 650 of case 610. Locking system 605 includes a pin 665 extending azimuthally within port 640, a lug 660 that is rotatable about pin 665, a leaf spring 670 in engagement with lug 660, and a screw 675 (FIG. 20) securing leaf spring 670 to bit retaining ring 630. Lug 660 has an end 680 in engagement with leaf spring 670. Further, the innermost, radially speaking, edge 685 of end 680 is cropped or rounded. In this embodiment, each lug 660 is essentially rectangular in cross-section, when viewed along the azimuth direction. However, in other embodiments, lug 660 may take other shapes, each having an end in engagement with leaf spring 670 with a cropped or rounded, radially innermost edge.

Lug 660 is rotatable about pin 665 between an unlocked position (FIGS. 17, 19) and a locked position (FIGS. 15, 20). When lug 660 is in the unlocked position (FIGS. 17, 19), lug 660 is rotated about pin 665 such that lug 660 is contained within pocket 640 of bit retaining ring 630, and no portion of lug 660 extends into recess 650 of case 610. When lug 660 is in the locked position (FIGS. 15, 20), lug 660 is rotated clockwise relative to its unlocked position such a portion of lug 660 extends into recess 650 of case 610. Cropped or rounded edge 685 enables rotation of lug 660 about pin 665 without limitation or interference from bit retaining ring 630. Thus, when lug 660 rotates about pin 665, edge 685 does not impede this rotational movement through contact with bit retaining ring 630.

Leaf spring 670 biases lug 660 toward its locked position, as illustrated by FIG. 20. In other words, in the absence of other force to lug 660, lug 660 will assume its locked position, as shown, with a portion of lug 660 extending into recess 650 of case 610. To rotate lug 660 about pin 665 from its locked position (FIGS. 15, 20) to its unlocked position (FIGS. 17, 19), a force must be applied to lug 660 sufficient to overcome the force exerted on lug 660 by leaf spring 670 and rotate lug 660 counterclockwise to retract lug 660 from recess 650 of case 610. When the applied force is subsequently removed, leaf spring 670 again rotates lug 660 clockwise, thereby returning lug 660 to its locked position (FIGS. 15, 20).

In the embodiment of FIGS. 14-20, lug 660 is rotatable from its locked position (FIGS. 15, 20) to its unlocked position (FIGS. 17, 19) by a mechanical contact load from drill bit 620. As shown in FIG. 19, drill bit 620 includes an outer surface 740 having a plurality of axial splines 760 configured to engage a plurality of axial splines (not shown) disposed along an inner surface of driver sub 615. Engagement of the splines on driver sub 615 with splines 760 on drill bit 620 enables case 610 to rotate drill bit 620 via driver sub 615. Further, when drill bit 620 is inserted within driver sub 615 such that at least one of splines 760 axially aligns with and engages lug 660, lug 660 is rotated clockwise into and held its unlocked position by the spline 760, as shown.

To rotate lug 660 from its unlocked position (FIGS. 17, 19) toward its locked position (FIGS. 15, 20), drill bit 620 is translated axially relative to bit retaining ring 630, and locking system 605 disposed therein, such that splines 760 of drill bit 620 disengage lug 660 (meaning drill bit 620 moving to the right in this figure). When drill bit 620 translates sufficiently to disengage lug 660, lug 660 rotates clockwise into its locked position (FIGS. 15, 20). To return lug 660 to its unlocked position (FIGS. 17, 19), drill bit 620 is subsequently translated axially in the opposite direction relative to bit retaining ring 630. When at least one spline 760 on drill bit 620 engages lug 660, lug 660 begins to rotate counterclockwise toward its unlocked position. Continued translation of drill bit 620 causes at least one of splines 760 to axially align with and hold lug 660 in its unlocked position (FIGS. 17, 19).

During assembly of percussion drilling assembly 600, drill bit 620 is inserted into driver sub 615 and bit retaining ring 630 coupled thereto to cause locking system 605 to assume its unlocked configuration (FIGS. 17, 19). With locking system 605 in its unlocked configuration (FIGS. 17, 19), driver sub 615 may then be threaded into tubular case 610 without interference from or engagement of lug 660 of locking system 605 with recess 650 of tubular case 610. Once assembled, percussion drilling assembly 600 is inserted downhole where drilling may commence. During operation of percussion drilling assembly 600, axial translation and rotation of drill bit 620 relative to locking system 605 locks driver sub 615 to and unlocks driver sub 615 from case 610.

When drill bit 620 assumes its on-bottom position, as illustrated by FIG. 17, locking system 605 is unlocked. More specifically, splines 760 on drill bit 620 axially align with locking system 605, and at least one of splines 760 engages lug 660, thereby causing lug 660 to rotate clockwise about pin 665 such that lug 660 is retracted from recess 650 of case 610. Rotation of drill bit 620 during drilling acts to tighten, not disengage, the threaded coupling between case 610 and driver sub 615. Thus, it is not necessary to lock these components 610, 615 via locking system 605 when drill bit 620 is on-bottom.

When drill bit 620 is lifted off-bottom, as illustrated by FIG. 15, drill bit 620 translates axially relative to locking system 605 under its own weight, thereby causing splines 760 of drill bit 620 to disengage lug 660. In the event that pocket 640 of bit retaining ring 630 is azimuthally aligned with recess 650 of case 610, lug 660 rotates counterclockwise about pin 665 such that a portion of lug 660 extends into recess 650 of case 610. Once locking system 605 is locked, meaning lug 660 extends into recess 650, rotation of drill bit 620 and vibrations resulting therefrom cannot cause driver sub 615 to inadvertently unthread from case 610. If pocket 640 of bit retaining ring 630 is not, however, azimuthally aligned with recess 650 of case 610, some back-off of driver sub 615 from case 610 is allowed to occur until pocket 640 and recess 350 align azimuthally, and lug 660 rotates into recess 650 to lock driver sub 615 to case 610.

Thus, depending upon the relative position of locking system 605 and drill bit 620, locking system 605 is locked and unlocked during operation of percussion drilling assembly 600. When drilling operations are complete and percussion drilling assembly 600 is pulled from the borehole, driver sub 615 may be decoupled from case 610 by first inserting drill bit 620 fully into driver sub 615 to cause locking system 605 to assume its unlocked configuration. Once locking system 605 is unlocked, driver sub 615 may be unthreaded from case 610.

In the previously described embodiment, lug 660 is rotatable about pin 665, which extends azimuthally within pocket 640 of bit retaining ring 630. Similarly, pawl 360 of locking system 305 (FIGS. 8-13) is rotatable about pin 365, which extends azimuthally within port 340 of driver sub 315. Due to the orientations of pins 365, 665, pawl 360 and lug 660 are rotatable in directions normal to the azimuth direction. In a modified embodiment of locking system 305, pin 365 may be oriented such that pin 365 extends axially, rather than azimuthally, within port 340 of driver sub 315, and pawl 360 is rotatable about pin 365 in directions normal to the axial, not azimuth, direction. Locking system 605 may be similarly modified to extend pin 665 axially within pocket 640 and enable lug 660 to be rotatable about pin 665 in directions normal to the axial direction. Aside from these directional differences, the structure and function of such modified embodiments of locking systems 305, 605 remain essentially the same as described above with reference to FIGS. 8-13 and FIGS. 14-20, respectively.

In the above described embodiments, the driver sub and case are locked, such that relative rotation of these components is not permitted, and unlocked to allow their relative rotation by axially translating the drill bit relative to the locking system. As described, the locking system is unlocked when the drill bit is on-bottom, and locked when drill bit is off-bottom. In still other embodiments, the driver sub is not locked and unlocked depending on the axial position of the drill bit relative to the locking system. Instead, the driver sub is permitted to rotate in one direction, such as the make-up direction, relative to the case, but prevented from rotation in the opposite direction, such as the back-off direction, regardless of whether the drill bit is off or on bottom.

Figure 21:
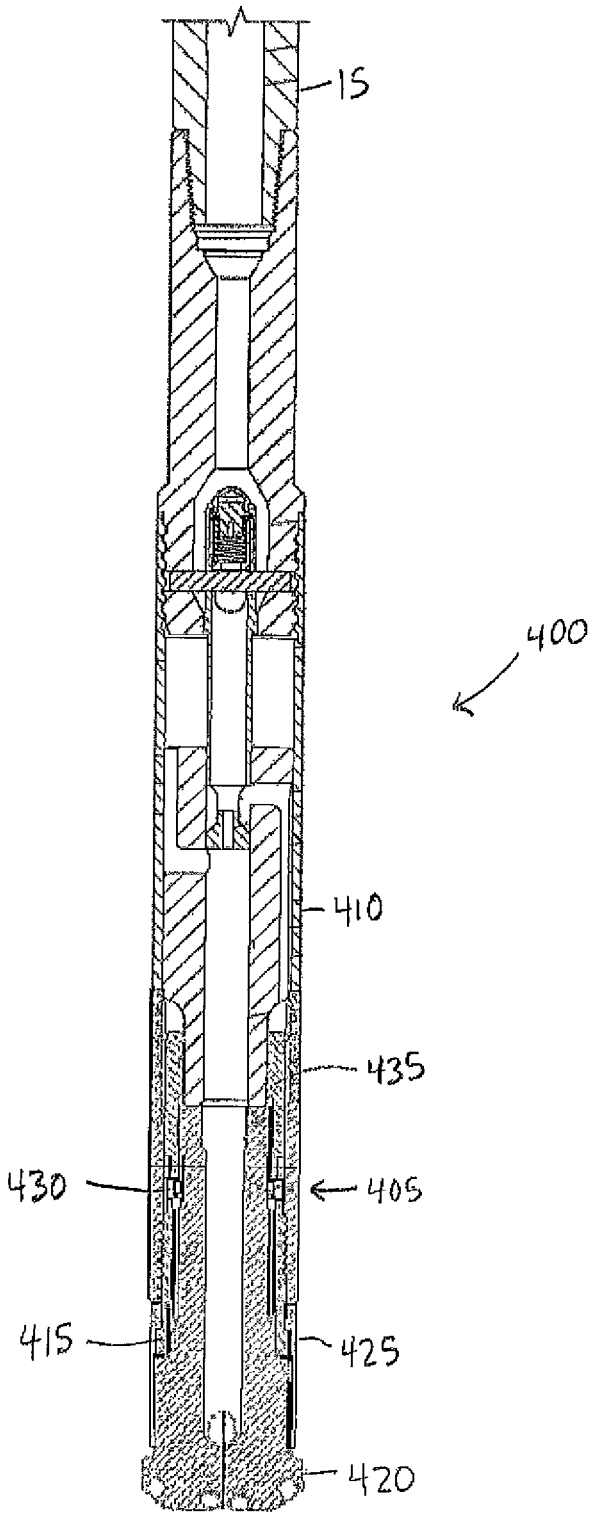
FIG. 21 is a cross-sectional view of a percussion drilling assembly including yet another embodiment of a locking system in accordance with the principles disclosed herein coupled to a drill string.

Turning now to FIG. 21, there is shown a percussion drilling assembly 400 coupled to a drill string 15 and including a locking system 405 in accordance with the principles disclosed herein. Assembly 400, as best viewed in FIG. 22, includes a tubular case 410 threadably coupled to a driver sub 415, a drill bit 420 slideably received by driver sub 415, a retainer sleeve 425 coupled to driver sub 415 and extending along the outer periphery of drill bit 420, and a bit retaining ring 430 and a guide sleeve 435 disposed axially upward of driver sub 415. Guide sleeve 435 includes an annular recess 440 within which locking system 405 is disposed.

In this embodiment, guide sleeve 435 and driver sub 415 are distinct components coupled by a plurality of pins or dowels, similar to the coupling of guide sleeve 135 and driver sub 115 of percussion drilling assembly 100 depicted in FIG. 2. Each pin or dowel extends radially between guide sleeve 435 and driver sub 415 to prevent rotation of guide sleeve 435 relative to driver sub 415. In other embodiments, guide sleeve 435 and driver sub 415 are integral, forming a single component threadably coupled to tubular case 410 and having at least one annular recess 440 wherein locking system 405 is disposed. Whether guide sleeve 435 and driver sub 415 are distinct components coupled by a plurality of dowels, as shown, or integrally formed, guide sleeve 435 does not rotate relative to driver sub 415.

Locking system 405 is configured to permit rotation of guide sleeve 435, and therefore, driver sub 415, in the make-up direction relative to case 410, and to prevent rotation of these components 415, 435 in the opposite, or back-off, direction relative to case 410. As used herein, the make-up direction is the direction which driver sub 415 must rotate relative to case 410 in order to engage mating threads 455 on these components 410, 415. The back-off direction is the opposite direction, or the direction in which driver sub 415 must rotate relative to case 410 in order to disengage mating threads 455. Thus, locking system 405 permits driver sub 415 to be threaded into case 410, such as during make-up. In the event driver sub 415 attempts to back-off from case 410 due to vibrations in assembly 400 during drilling operations, locking system 405 engages driver sub 415 and case 410 to prevent their relative rotation.

Guide sleeve 435 further includes an inner surface 505 having a larger diameter portion 510, a smaller diameter portion 515, and an angled shoulder 520 extending therebetween. Similarly, drill bit 420 includes an outer surface 525 having a larger diameter portion 530, a smaller diameter portion 535, and an angled shoulder 540 extending therebetween. There is radial clearance 545 between guide sleeve 435 and drill bit 420 proximate locking system 405. The magnitude of clearance 545 varies depending on the axial position of drill bit 420 relative to guide sleeve 435. Regardless, clearance 545 is sufficient to allow larger diameter portion 530 of drill bit 420 to pass within smaller diameter portion 515 of guide sleeve 435 as drill bit 420 is inserted within guide sleeve 435 during assembly.

Figure 23:
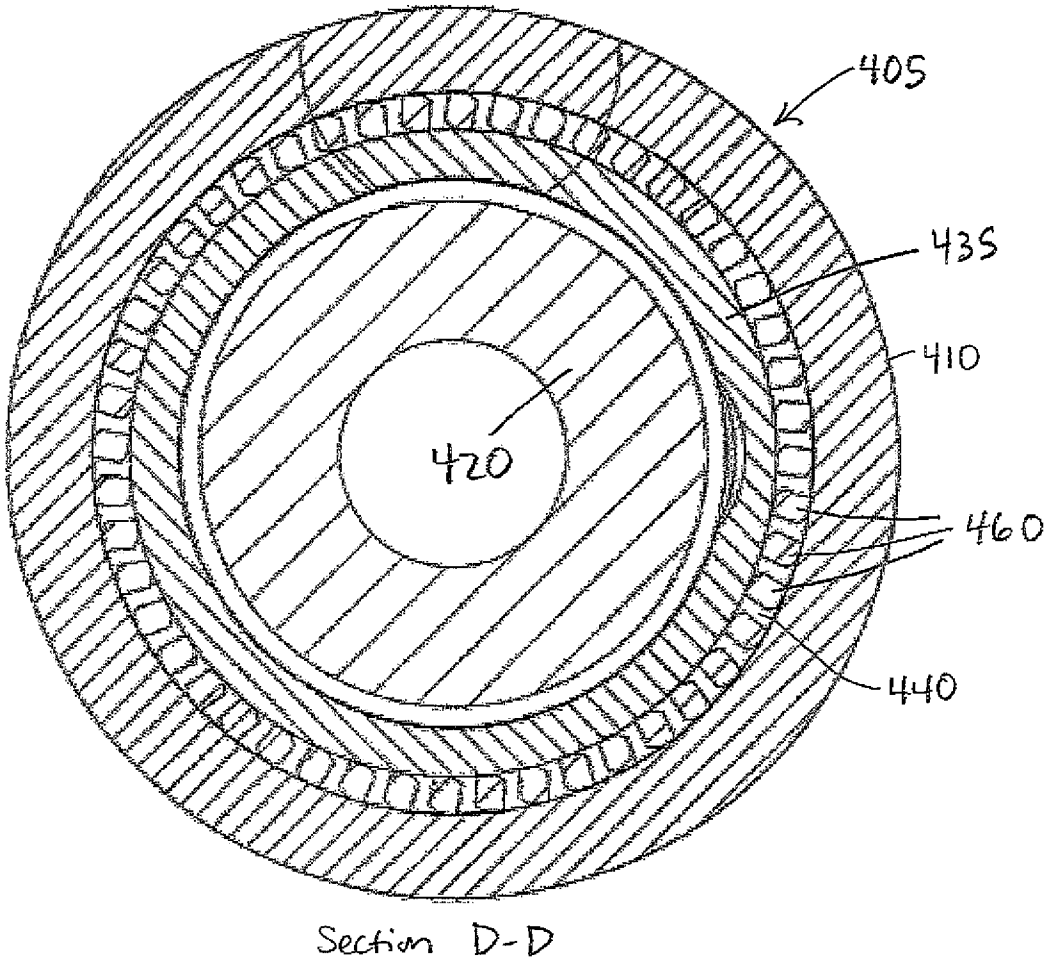
FIG. 23 is a radial cross-section through the locking system at Section D-D of FIG. 22.

Referring now to FIG. 23, locking system 405 is disposed within annular recess 440 between guide sleeve 435 and case 410. Locking system 405 includes a plurality of rotatable pawls or sprags 460 azimuthally distributed within annular recess 440 about guide sleeve 435. As best viewed in FIG. 24, each pawl 460 has two opposing, cropped or rounded edges 470, 475 and two opposing, full edges 480, 485. The span 472 of pawl 460 between edges 470, 475 is less than the width 474 of annular recess 440. The span 476 of pawl 460 between edges 480, 485 is greater than width 474. In this embodiment, each pawl 460 is essentially rectangular in cross-section, when viewed along the axial direction. However, in other embodiments, pawls 460 may take other shapes. Further, pawls 460 may be held in place using a suitable housing (not shown) and one or more springs to maintain contact with an inner surface 500 of case 410 and an outer surface 495 of guide sleeve 435.

Figure 25:
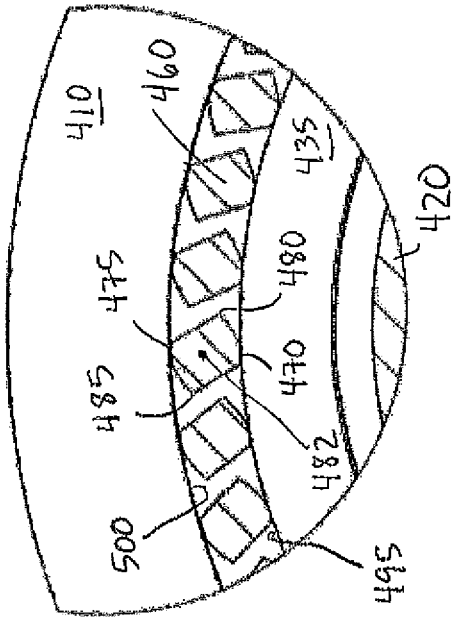
FIG. 25 is an enlarged portion of a radial cross-section of the locking system of FIG. 23 with the pawls in their disengaged positions.

Each pawl 460 is rotatable about its longitudinal axis 482 between a disengaged position (FIGS. 23, 25) and an engaged position (FIG. 24) under contact from guide sleeve 435 when guide sleeve 435 rotates relative to case 410. From the configuration illustrated by FIG. 24, clockwise rotation of guide sleeve 435 relative to case 410 causes guide sleeve 435 to contact pawls 460 at their edges 480. Each pawl 460 responds by rotating counterclockwise about its longitudinal axis 482 until all of its edges 470, 475, 480, 485 disengage guide sleeve 435 and case 410, as shown in FIG. 25. Rotation of each pawl 460 in this manner is enabled by its cropped or rounded edges 470, 475 and span 472, which is less than width 474 of annular recess 440. With pawls 460 now in their disengaged positions, as illustrated by FIG. 25, guide sleeve 435 is free to rotate clockwise relative to case 410.

Figure 24:
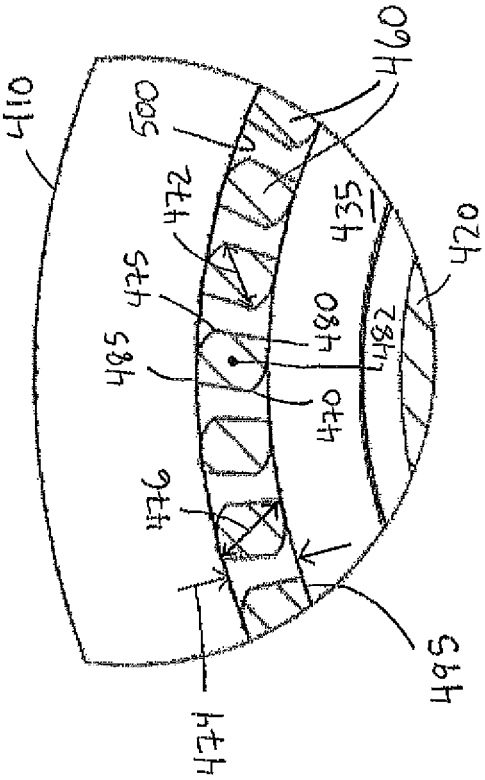
FIG. 24 is an enlarged portion of a radial cross-section of the locking system of FIG. 23 with the pawls in their engaged positions.

In the event guide sleeve 435 rotates in the opposite, or counterclockwise, direction, guide sleeve 435 again contacts edges 480 of pawls 460. This time, however, each pawl 460 responds by rotating clockwise about its longitudinal axis 482 until edge 480 snugly engages outer surface 495 of guide sleeve 435 and edge 485 snugly engages inner surface 500 of case 410, as shown in FIG. 24. Engagement of edges 480, 485 with guide sleeve 435 and case 410, respectively, is enabled by span 476, which is greater than width 474 of annular recess 474. Once pawls 460 assume their engaged positions, illustrated by FIG. 24, guide sleeve 435 is prevented from further counterclockwise rotation relative to case 410.

In this embodiment, guide sleeve 435 is rotatable in the clockwise direction relative to case 410 due to the position of rounded edges 470, 475 at the "1:30 o'clock" and "7:30 o'clock" positions on each pawl 460, but prevented from counterclockwise rotation due to full edges 480, 485 at the "4:30 o'clock" and "10:30 o'clock" positions. Thus, the make-up direction is clockwise, and the back-off direction is counterclockwise. Consequently, driver sub 415 with guide sleeve 435 and locking system 405 is rotated in the clockwise direction relative to case 410 during make-up of driver sub 415 to case 410. Also, during drilling operations, driver sub 415 is permitted to further thread into case 410 in the event that the applied torque exceeds the torque required for make-up. This further tightening of driver sub 415 into case 410 is permitted by locking system 405 due to rounded edges 470, 475 of pawls 460 and span 472, which is less than width 474 of annular recess 440. In the event that driver sub 415 attempts to back-off from case 410, locking system 405 prevents rotation of driver sub 415 in the counterclockwise direction relative to case 410 due to full edges 480, 485 of pawls 460 and span 476, which exceeds width 474 of annular recess 440.

In other embodiments, the positions of rounded edges 470, 475 and full edges 480, 485 may be reversed. In such embodiments, the make-up and back-off directions would, as a result, also be reversed, meaning the make-up and back-off directions would counterclockwise and clockwise, respectively, rotation of driver sub 415 relative to case 410. Further, in still other embodiments, the unidirectional locking mechanism of pawls 460 may be replaced with a roller-ramp design conventionally used in clutch applications.

Figure 22:
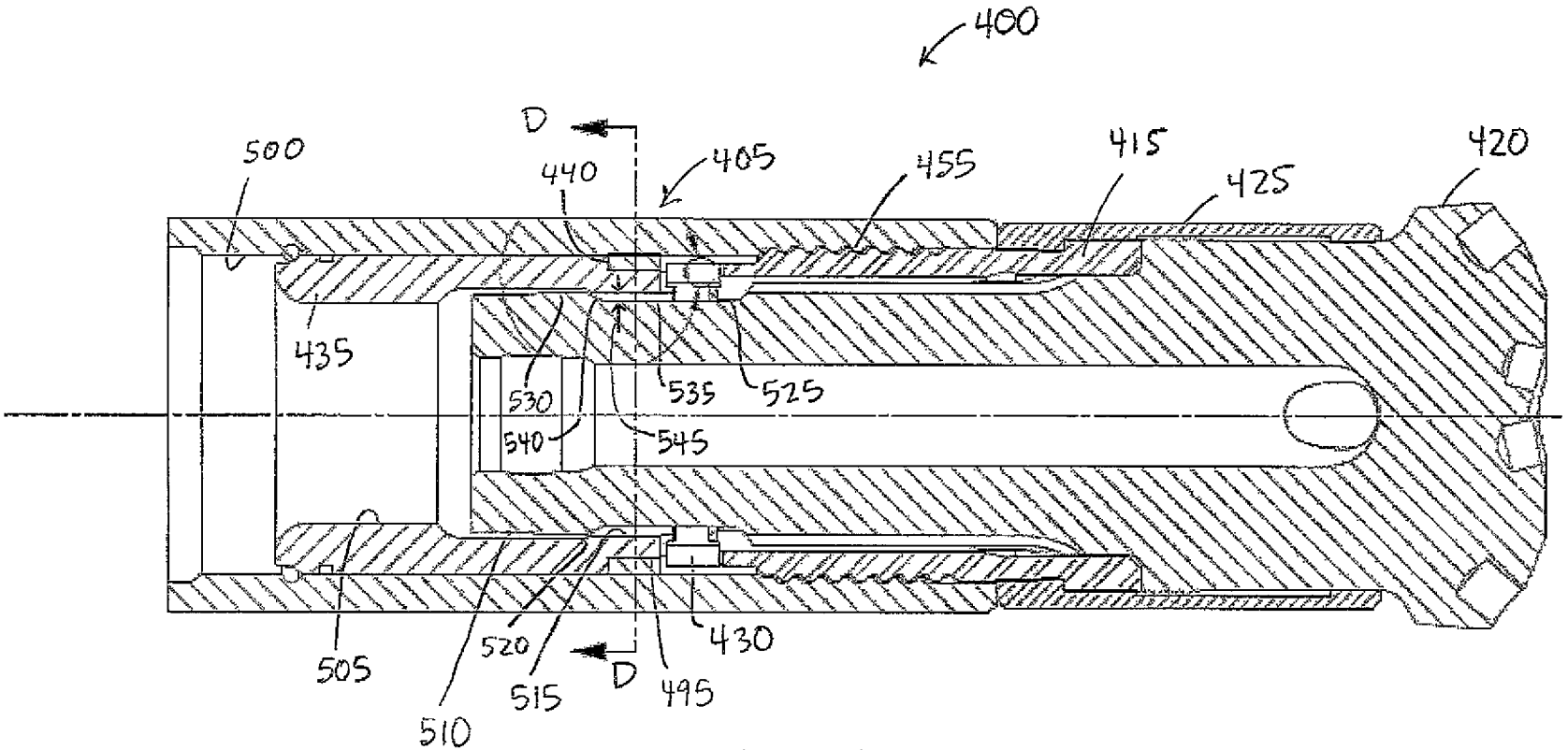
FIG. 22 is an enlarged cross-sectional view of a portion of the percussion drilling assembly of FIG. 21, wherein the locking system is disengaged.

During assembly of percussion drilling assembly 400, driver sub 415 is threaded into case 410. As driver sub 415 is made up to case 410, rotation of guide sleeve 435 relative to case 410 causes locking system 405 to assume a disengaged configuration (FIGS. 20, 22). Specifically, rotation of guide sleeve 435 in the make-up direction causes pawls 460, in turn, to rotate to their disengaged positions (FIGS. 20, 22). This allows guide sleeve 435 to rotate relative to case 410 without interference from pawls 460, and driver sub 415 to be made up to case 410. Once assembled, percussion drilling assembly 400 is inserted downhole where drilling may commence.

When drill bit 420 assumes its on-bottom position, illustrated by FIG. 22, during drilling operations, locking system 405 remains in its disengaged configuration (FIGS. 23, 25) because rotation of case 410 during drilling acts to tighten, not disengage, threads 455 between case 410 and driver sub 415. In other words, guide sleeve 435, coupled to driver sub 415, rotates in the make-up direction relative to case 410. As a result, pawls 460 remain in their disengaged positions (FIGS. 23, 25).

Figure 26:
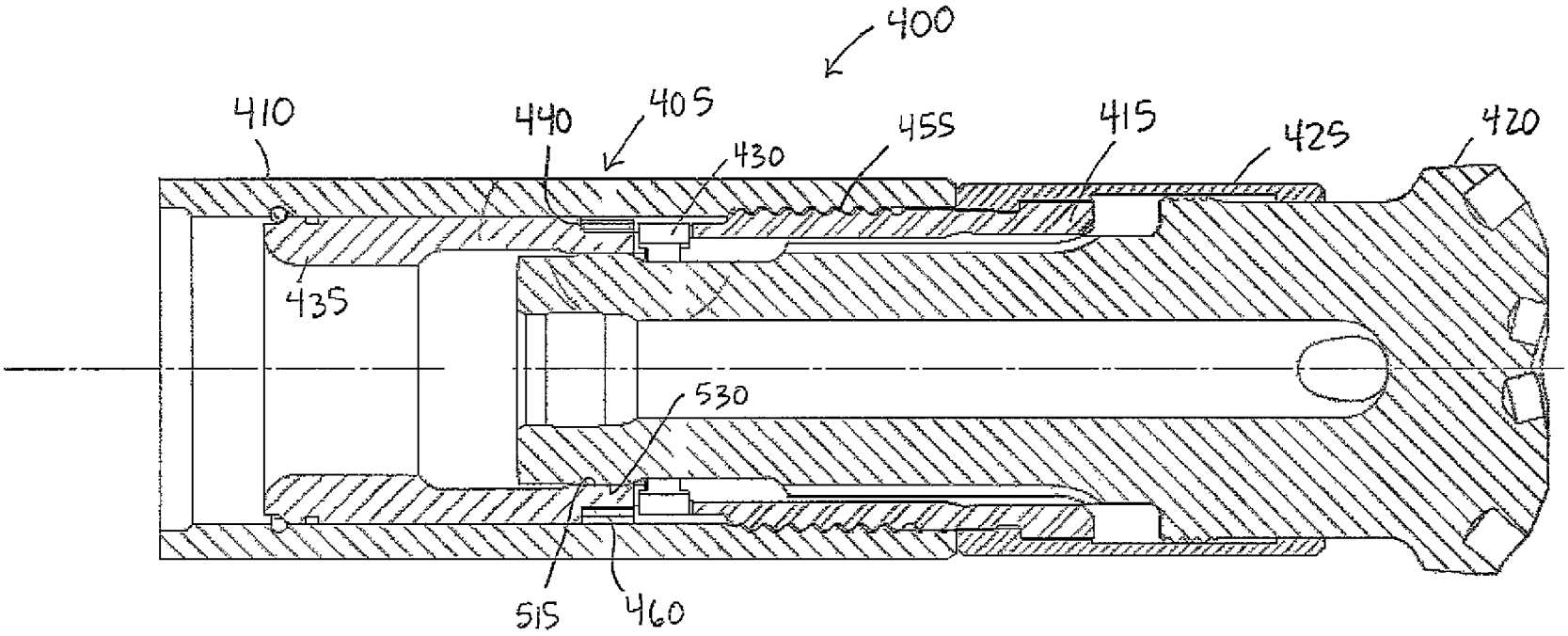
FIG. 26 is a cross-sectional view of the percussion drilling assembly of FIG. 21 in the off-bottom position.

When drill bit 420 is lifted off-bottom, as illustrated by FIG. 26, drill bit 420 translates relative to guide sleeve 435 under its own weight, thereby aligning larger diameter portion 530 of drill bit 420 with smaller diameter portion 515 of guide sleeve 435. In the event that driver sub 415 attempts to back-off from case 410, perhaps due to operational vibrations in either or both components 410, 415, locking system 405 assumes its engaged configuration. Specifically, rotation of guide sleeve 435 in the back-off direction relative to case 410 causes pawls 460, in turn, to rotate from their disengaged positions (FIGS. 23, 25) to their engaged positions (FIG. 24). Once pawls 460 engage both guide sleeve 435 and case 410, further rotation of guide sleeve 435 in the back-up direction relative to case 410 is prevented. Thus, driver sub 415 is prevented from backing-off and disengaging case 410.

Moreover, alignment of larger diameter portion 530 of drill bit 420 with smaller diameter portion 515 of guide sleeve 435 minimizes clearance 545 between drill bit 420 and guide sleeve 435, and enables drill bit 420 to provide structural support to guide sleeve 435 proximate locking system 405. The support provided to guide sleeve 435 by drill bit 420 proximate locking system 405 prevents guide sleeve 435 from deforming under load from pawls 460 as driver sub 415 attempts to back-off case 410 and enables pawls 460 to remain in their engaged positions (FIGS. 21, 23).

Thus, depending upon the rotational direction of guide sleeve 435 relative to case 410, locking system 405 is configured to engage or disengage sleeve 435 and case 410, thereby preventing back-off of driver sub 415 from case 410 or enabling make-up of these components 410, 415, respectively. When drilling operations are complete and percussion drilling assembly 400 is pulled from the borehole, driver sub 415 may be decoupled from case 410 by first setting drill bit 420 in its on-bottom position and disengaging locking system 405. After drill bit 420 is removed from within guide sleeve 435, driver sub 415 may then be unthreaded from case 410.

While various embodiments have been showed and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A percussion drilling assembly for drilling through earthen formations and forming a borehole, the assembly coupled to the lower end of a drillstring and comprising:

an outer tubular;

an inner tubular coupled within the outer tubular at a threaded region;

a drill bit slideably disposed within the inner tubular; and a locking system located proximate the threaded region and actuatable by translation of the drill bit relative to the locking system, the locking system comprising a plurality of locking members disposed between the inner and outer tubulars and extendable between at least two positions, including:

an engaged position configured to prevent rotation of the inner tubular relative to the outer tubular in at least a first direction; and a disengaged position configured to enable rotation of the inner tubular relative to the outer tubular in a second direction opposite that of the first direction.

2. The percussion drilling assembly of claim 1, the plurality of locking members being rotatable between the engaged and disengaged positions.

3. The percussion drilling assembly of claim 2, wherein each of the locking members is rotatable about a longitudinal axis extending therethrough and parallel to a centerline of the inner tubular.

4. The percussion drilling assembly of claim 1, wherein the locking system comprises at least one of the plurality of locking members disposed in a void within a wall of the inner tubular, the at least one locking member:

extendable to a locked position, wherein a portion of the at least one locking member extends into a recess in an inner surface of the outer tubular; and retractable to an unlocked position, wherein the at least one locking member is retracted from the recess.

5. The percussion drilling assembly of claim 4, wherein the at least one locking member is rotatable between the locked and the unlocked positions.

6. The percussion drilling assembly of claim 4, wherein the at least one locking member is translatable between the locked and the unlocked positions.

7. The percussion drilling assembly of claim 4, wherein the locking system further comprises a spring that biases the at least one locking member to the locked position.

8. A percussion drilling assembly for drilling through earthen formations and forming a borehole, the assembly coupled to the lower end of a drillstring and comprising:

an outer tubular;

an inner tubular coupled within the outer tubular at a threaded region; and a plurality of locking members disposed therebetween and located proximate the threaded region, each locking member rotatable between:

an engaged position, wherein the inner tubular is prevented from rotating relative to the outer tubular in a first direction; and a disengaged position, wherein the inner tubular is rotatable relative to the outer tubular in a second direction opposite the first direction.

9. The percussion drilling assembly of claim 8, wherein each of the plurality of locking members comprises:

two opposing edges configured to enable rotation of the locking member in the first direction; and two opposing edges configured to prevent rotation of the locking member in the second direction.

10. The percussion drilling assembly of claim 9, further comprising a support member disposed within the inner tubular and having an outer surface with a large diameter portion, the support member translatable to position the large diameter portion radially inward of the plurality of locking members, whereby the support member provides structural support to the inner tubular to resist further rotation of the plurality of the locking members in the second direction.

11. The percussion drilling assembly of claim 9, wherein the plurality of locking members forms a unidirectional sprag-type clutch.

12. The percussion drilling assembly of claim 9, wherein the outer tubular is a tubular case and the inner tubular is a guide sleeve.

13. A percussion drilling assembly for drilling through earthen formations and forming a borehole, the assembly coupled to the lower end of a drillstring and comprising:

an outer tubular having an inner surface with a recess formed therein;

an inner tubular coupled within the outer tubular at a threaded region, the inner tubular having a wall with a void formed therein; and a locking system located proximate the threaded region and disposed within the void, the locking system comprising a locking member that is:

extendable to a locked position, wherein a portion of the locking member is received within the recess, whereby rotation of the inner tubular relative to the outer tubular is prevented in at least a first direction; and retractable to an unlocked position, wherein the locking member is retracted from the recess, whereby rotation of the inner tubular relative to the outer tubular is enabled.

14. The percussion drilling assembly of claim 13, wherein the locking member is translatable between the locked and the unlocked positions.

15. The percussion drilling assembly of claim 14, wherein the locking member is pin having a flanged portion extending therefrom; and wherein the locking system further comprises:

a ring disposed about the pin and coupled to the inner tubular, the ring configured to limit translation of the pin toward the recess; and a compressible member disposed between the ring and the flanged portion of the pin, the compressible member configured to bias the pin toward the unlocked position.

16. The percussion drilling assembly of claim 15, wherein the compressible member is a spring.

17. The percussion drilling assembly of claim 15, further comprising an actuating member disposed within the inner tubular and having an outer surface with a large diameter portion and a small diameter portion, the actuating member translatable between:

a first position, wherein the large diameter portion engages the pin, whereby the pin assumes the locked position; and a second position, wherein the small diameter portion is radially inward of the pin, wherein the pin assumes the unlocked position.

18. The percussion drilling assembly of claim 17, wherein the outer tubular is a tubular case, the actuating member is a drill bit, and the inner tubular is one or more of a group consisting of a guide sleeve, a bit retaining ring, and a driver sub.

19. The percussion drilling assembly of claim 13, wherein, when the locking member is extended to the locked position, rotation of the inner tubular relative to the outer tubular in the first direction is prevented, and rotation of the inner tubular relative to the outer tubular in a second direction opposite the first direction is enabled.

20. The percussion drilling assembly of claim 19, wherein the locking member is rotatable between the locked and the unlocked positions.

21. The percussion drilling assembly of claim 19, wherein the locking system further comprises a pin extending within the void and a spring coupled to the locking member and wherein the locking member is biased by the spring to the locked position.

22. The percussion drilling assembly of claim 19, wherein the recess is bounded by a radially extending surface and two opposing and axially extending surfaces, one axially extending surface substantially normal to the radially extending surface and the other axially extending surface ramped relative to the radially extending surface.

23. The percussion drilling assembly of claim 19, further comprising an actuating member disposed within the inner tubular and having an outer surface with an axial spline extending therefrom, the actuating member translatable between:

a first position, wherein the axial spline engages the locking member, whereby the locking member assumes the locked position; and a second position, wherein the axial spline disengages the locking member, whereby the locking member assumes the unlocked position.

24. The percussion drilling assembly of claim 23, wherein the outer tubular is a tubular case, the actuating member is a drill bit, and the inner tubular is one or more of a group consisting of a guide sleeve, a bit retaining ring, and a driver sub.

* * * * *